US005346418A

United States Patent [19]

Arad

[11] Patent Number: 5,346,418

[45] Date of Patent: Sep. 13, 1994

[54] KIT FOR ASSEMBLING TOY WEAPONS

[75] Inventor: Avi Arad, Westport, Conn.

[73] Assignee: Toy Biz, Inc., New York, N.Y.

[21] Appl. No.: 955,311

[22] Filed: Oct. 1, 1992

[51] Int. Cl.[5] ..... A63H 5/04

[52] U.S. Cl. ..... 446/91; 446/405; 446/473; 446/485

[58] Field of Search ..... 446/473, 91, 485, 397, 446/405, 406, 407, 401, 484, 144, 145, 69

[56] References Cited

U.S. PATENT DOCUMENTS

| | | | |
|---|---|---|---|
| 3,412,503 | 11/1968 | Ryan et al. | 446/473 X |
| 4,571,201 | 2/1986 | Matsuda | 446/85 |
| 4,717,365 | 1/1988 | Andersen et al. | 446/473 X |
| 5,145,446 | 9/1992 | Kuo | 446/405 |

OTHER PUBLICATIONS

Videotape Advertisement, "Topper's Johnny Seven One Man Army Gun".

*Primary Examiner*—Mickey Yu

*Attorney, Agent, or Firm*—Amster, Rothstein & Ebenstein

[57] ABSTRACT

A kit for assembling a plurality of toy weapons includes a basic weapon having a first configuration and a first plurality of conversion adaptors for converting the basic weapon to a second plurality of different weapon configurations. The basic weapon and at least one of the adaptors are releasably securable together to form a second plurality of weapons, the second plurality being greater than the first plurality. The basic weapon may include a compartment for an electrical power supply, as well as a light generator and a sound generator associated with the power supply for providing light and a variety of different sounds when activated.

26 Claims, 22 Drawing Sheets

KIT FOR ASSEMBLING TOY WEAPONS

BACKGROUND OF THE INVENTION

The present invention relates to kits for assembling a plurality of toy weapons and, more particularly, a plurality of toy weapons which upon activation may generate light and sound depending upon the toy weapons selected.

Given the limited interest span of most children in any given toy of a fixed configuration and function, no matter how fascinating the toy may be, the play value of a toy over time may be related to the ability of the toy to assume different configurations and functions over time. Thus a kit from which may be assembled a plurality of toy weapons is highly desirable.

Such kits have not, however, proven to be entirely satisfactory in use. Typically a kit has a basic weapon and a plurality of conversion means or possible attachments thereto for converting the basic weapon into weapons of different configurations depending upon which conversion means is associated with the basic weapon at a given time. Thus the number of weapon configurations which can be formed is equal to the number of different conversion means provided plus one (the one representing the basic weapon without any conversion means). Accordingly, the number of conversion means provided in a kit provides an absolute limit (that is, the number of conversion means) on the number of toy weapons which can be made from the kit using both the basic weapon and at least one of the conversion means.

Also, the conversion means of the known kits are strictly "add-ons", by which is meant a conversion means which adds to, but in no substantial way changes, the identity and essential appearance of the basic weapon. For example, an add-on which does not alter the identity or essential appearance of a rifle might be a bayonet, a telescopic sight, a laser sight, a silencer, an extended ammunition magazine, and the like. Any portion of the basic rifle which is covered or concealed by the conversion means is only minimal in nature (typically only to permit connection of the conversion means to the basic rifle) and does not substantially alter or conceal the identity and essential appearance of the basic weapon. Accordingly, the extra play value provided by the several conversion means is severely restricted as the basic weapon remains merely the basic weapon with the different add-ons not changing its inherent character.

Further, where the basic weapon of the kit is capable of producing light or sound effects when activated (e.g., by a trigger), thereby to increase the play value thereof, the addition of conversion means to the basic weapon may produce different weapon configurations (i.e., appearances), but does not alter or vary the light and sound effects produced by the basic weapon. Accordingly, the increase in play value provided by the conversion means is again severely limited as the same sound and light effects are being produced in all the weapons regardless of their configurations.

Accordingly, it is an object of the present invention to provide a kit for assembling a plurality of toy weapons where the basic weapon and at least one of a first plurality of conversion means are releasably securable together to form a second plurality of weapons greater than the first plurality of conversion means available.

Another object is to provide such a kit wherein, in a preferred embodiment, at least one of the conversion means, when used, substantially conceals and converts the identity and essential appearance of the basic weapon.

A further object is to provide such a kit wherein, in a preferred embodiment, the basic weapon includes means for producing light and sound effects, the light and sound effects produced may vary with the conversion means attached thereto to form the different weapon configurations.

It is also an object of the present invention to provide such a kit wherein the basic weapon and the various conversions means may be easily assembled and disassembled without the use of tools.

SUMMARY OF THE INVENTION

The above and related objects and advantages of the present invention are obtained in a kit for assembling a plurality of toy weapons, comprising a basic weapon having a first configuration, and a first plurality of conversion means for converting the basic weapon to a second plurality of different weapon configurations. The basic weapon and at least one of the conversion means are releasably securable together to form a second plurality of weapons, the second plurality being greater than the first plurality.

In a preferred embodiment, one of the first plurality of conversion means and another of the first plurality of conversion means are directly releasably securable together to form with the basic weapon a third weapon different from both the basic weapon and the second plurality of weapons. At least a portion of one of the conversion means and at least a portion of the basic weapon are telescopically releasably securable together to form one of the second plurality of weapons. One of the first plurality of conversion means releasably secured directly to the basic weapon in one of the second plurality of different weapon configurations and to another one of the first plurality of conversion means in another of the second plurality of different weapon configurations.

Preferably, the first plurality is at least three, the second plurality is at least six. Optimally, the first plurality is not in excess of three and the second plurality is at least six, five or four, or the first plurality is not in excess of two and the second plurality is at least three.

The invention further encompasses a kit for assembling a plurality of toy weapons, comprising a basic weapon having a first configuration including a compartment for a portable power supply, means associated with the power supply for providing light when activated, and a plurality of means associated with the power supply for producing different sounds when activated. A first plurality of conversion means are provided for converting the basic weapon to a second plurality of different weapon configurations, the basic weapon and each of the conversion means being releasably securable together to form a second plurality of weapons.

In a preferred embodiment, the basic weapon additionally includes a first plurality of manually operable triggers, each of the triggers activating the light providing means and a respective one of the plurality of sound providing means. The basic weapon and a given one of the first plurality of conversion means includes a switch means, actuated by the releasable securing together of the basic weapon and the given one conversion means for changing the sounds generated by the sound producing means upon subsequent operation of the triggers. One of the first plurality of conversion means includes a manually operable switch means for changing all of the sounds provided by operation of each of the triggers to different sounds.

Preferably the basic weapon has first contacting means, and at least one of the first plurality of conversion means has a second plurality of manually operable triggers and second contact means, the second contact means being engageable with the first contact means for varying the sound provided by the sound providing means upon operation of the first and second plurality of triggers. One of the at least one conversion means and another of the first plurality of conversion means includes a switch means, actuated by the releasable securing together of the basic weapon, the at least one conversion means and the another conversion means, for changing the sounds generated by the sound producing means upon subsequent operation of the triggers.

In a specific embodiment, the kit for assembling a plurality of toy weapons comprises a basic weapon having a first configuration (power dagger). Also provided are first conversion means (power sword) for converting the basic weapon to a second configuration (power sword), at least a portion of the basic weapon and at least a portion of the first conversion means being releasably securable together to form a second weapon (power sword). Further provided are second conversion means (machine gun) (i) for converting the basic weapon to a third configuration (army machine gun), at least a portion of the basic weapon and at least a portion of the second conversion means being telescopically releasably securable together to form a third weapon (army machine gun), and (ii) for converting the second weapon to a fourth configuration (bayonet machine gun), at least a portion of the second weapon and at least a portion of the second conversion means being releasably securable together to form a fourth weapon (bayonet machine gun). Finally provided are third conversion means (tube) (i) for converting the basic weapon to a fifth configuration (laser sword), at least a portion of the basic weapon and at least a portion of the third conversion means being releasably securable to form a fifth weapon (laser sword), and (ii) for converting the third weapon into a sixth configuration (cyber gun), at least a portion of the third weapon and at least a portion of the third conversion means being releasably securable together to form a sixth weapon (cyber gun), and (iii) for converting the fourth weapon into a seventh configuration (super weapon) at least a portion of the fourth weapon and at least a portion of the third conversion means being releasably securable together to form a seventh weapon (super weapon).

In the specific embodiment, the third conversion means is releasably secured directly to the basic weapon in the fifth configuration and to the second conversion means in the sixth and seventh configurations. The basic weapon includes a compartment for a portable power supply, means associated with the power supply for providing light when activated, and a plurality of means associated with the power supply for producing different sounds when activated. The basic weapon additionally includes a first plurality of manually operable triggers, each of the triggers activating the light providing means and a different one of the plurality of sound providing means. The basic weapon further contains first contact means, and the second conversion means additionally includes a second plurality of manually operable triggers and second contact means, the second contact means being engageable with the first contact means for varying the sounds provided upon operation of the first and second pluralities of triggers. The basic weapon includes a switch, actuated by the releasable securing of the third conversion means and the basic weapon together, for changing the sounds generated by subsequent actuation of the first plurality of triggers. The second conversion means includes manually operable switching means for changing all of the sounds provided by operation of each of the triggers to different sounds. The second conversion means includes means for sensing the releasable securing together of the first and third conversion means thereto and for causing the sound providing means to provide different sounds upon operation of the triggers.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIGS. 32–36 are side elevational, top plan, bottom plan, rear elevational and front elevational views., respectively, of a seventh toy weapon ("super weapon") formed by combining all of the additional components (the tube, sword, and machine gun conversion means), with portions cut away in the side elevational view to reveal details of internal construction; an;

DETAILED DESCRIPTION OF THE PREFERRED EMBODIMENTS

Figure 1A:
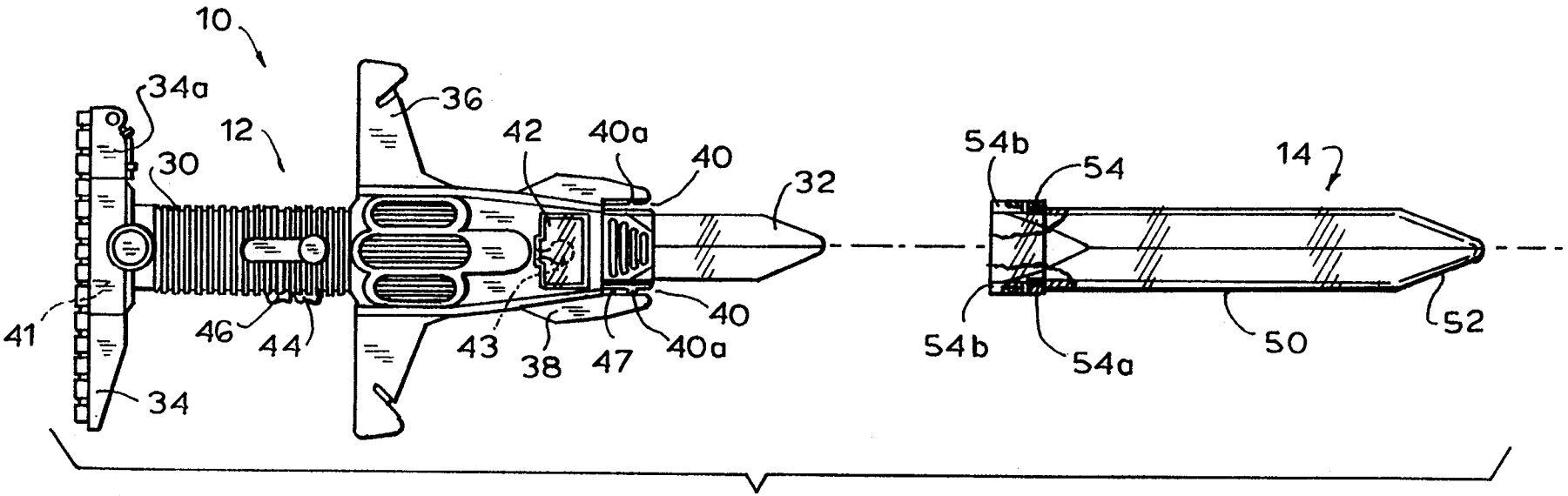
FIGS. 1A and 1B together are a side elevational view of the four components of a kit according to the present invention containing a basic weapon and a plurality of conversion means.
Figure 1B:
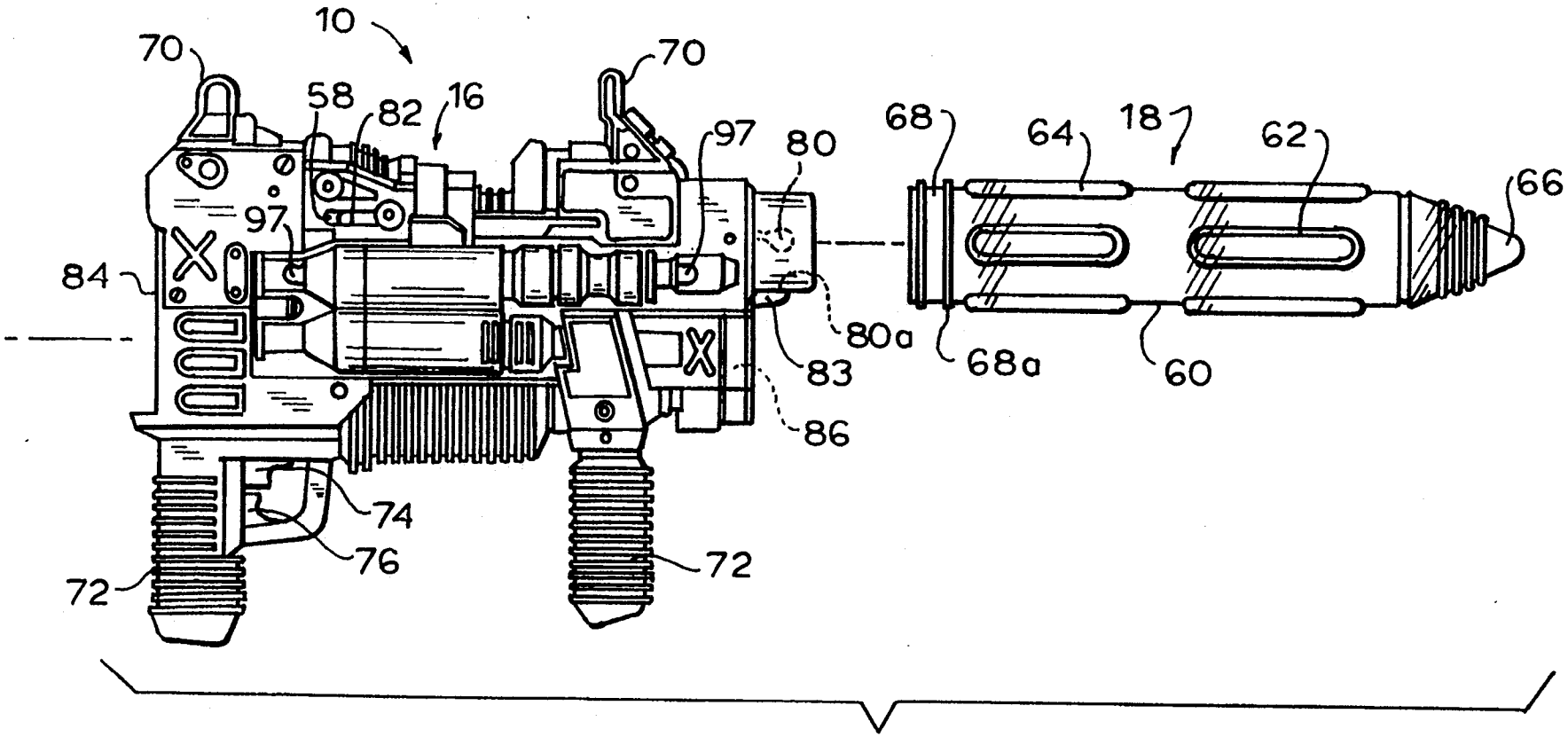
Figure 2:
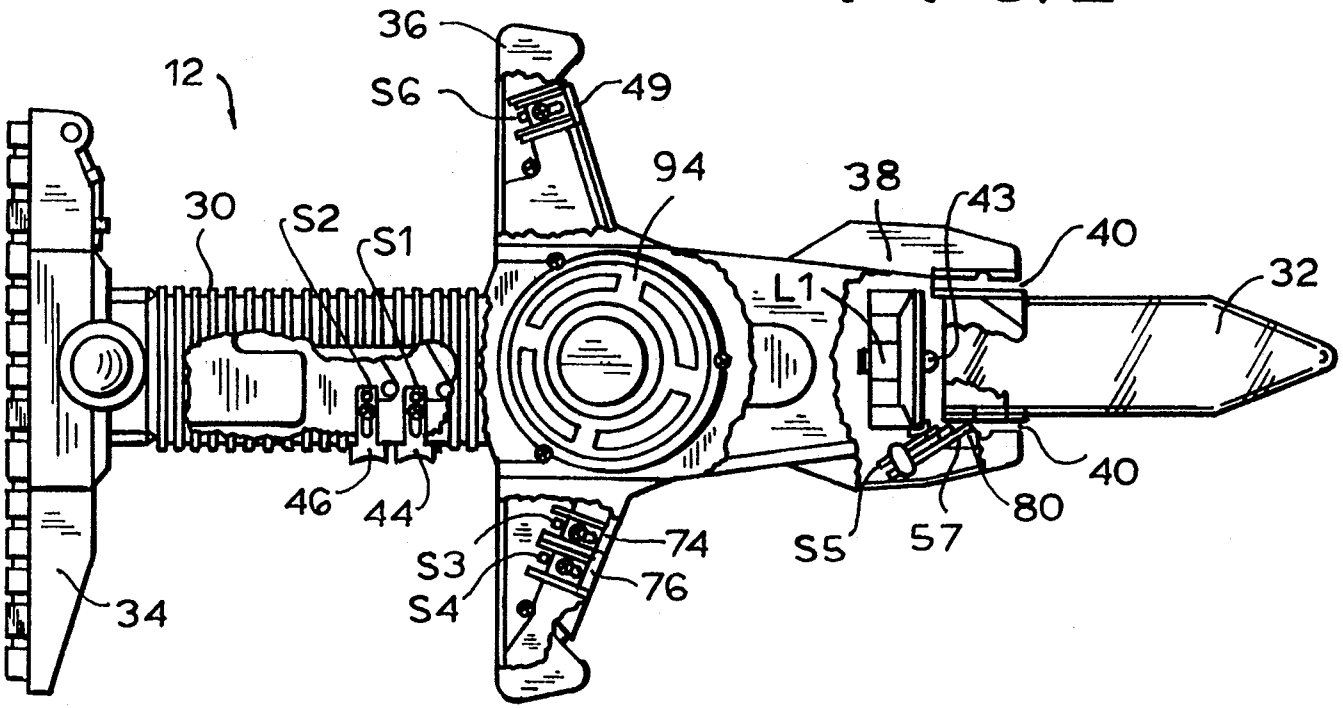
FIGS. 2–6 are side elevational, top plan, bottom plan, rear elevational and front elevational views, respectively, of a first toy weapon ("power dagger") formed by the basic component thereof, with portions cut away in the side elevational view to reveal details of internal construction.
Figure 3:
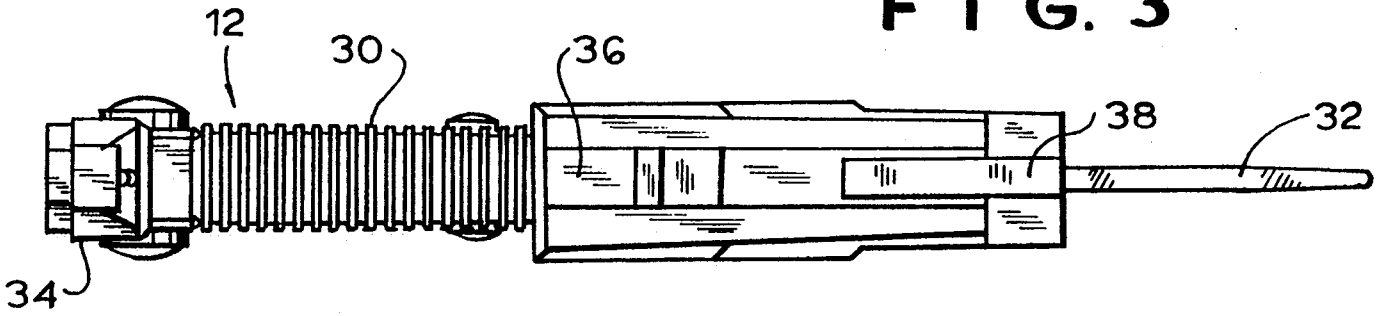
Figure 4:
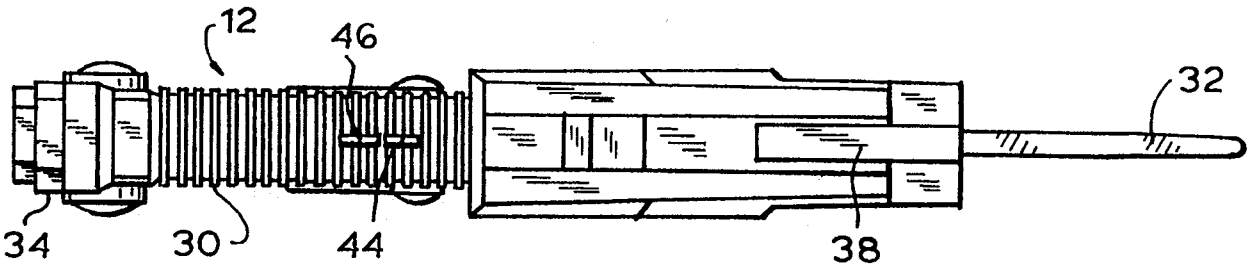
Figure 6:
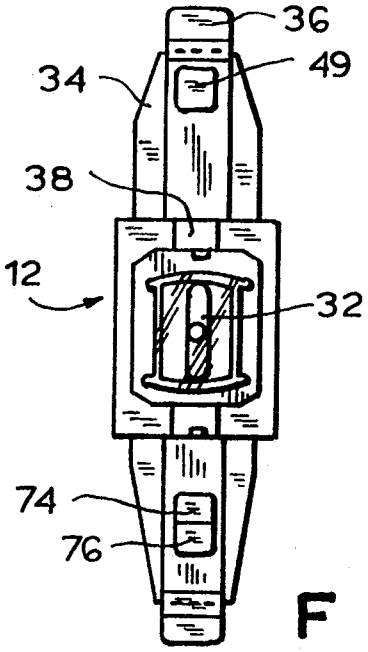
Figure 5:
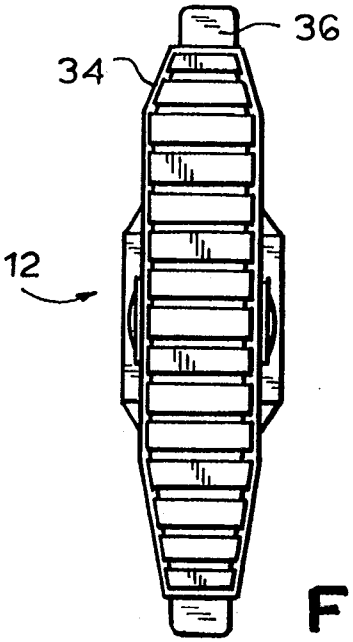
Figure 7:
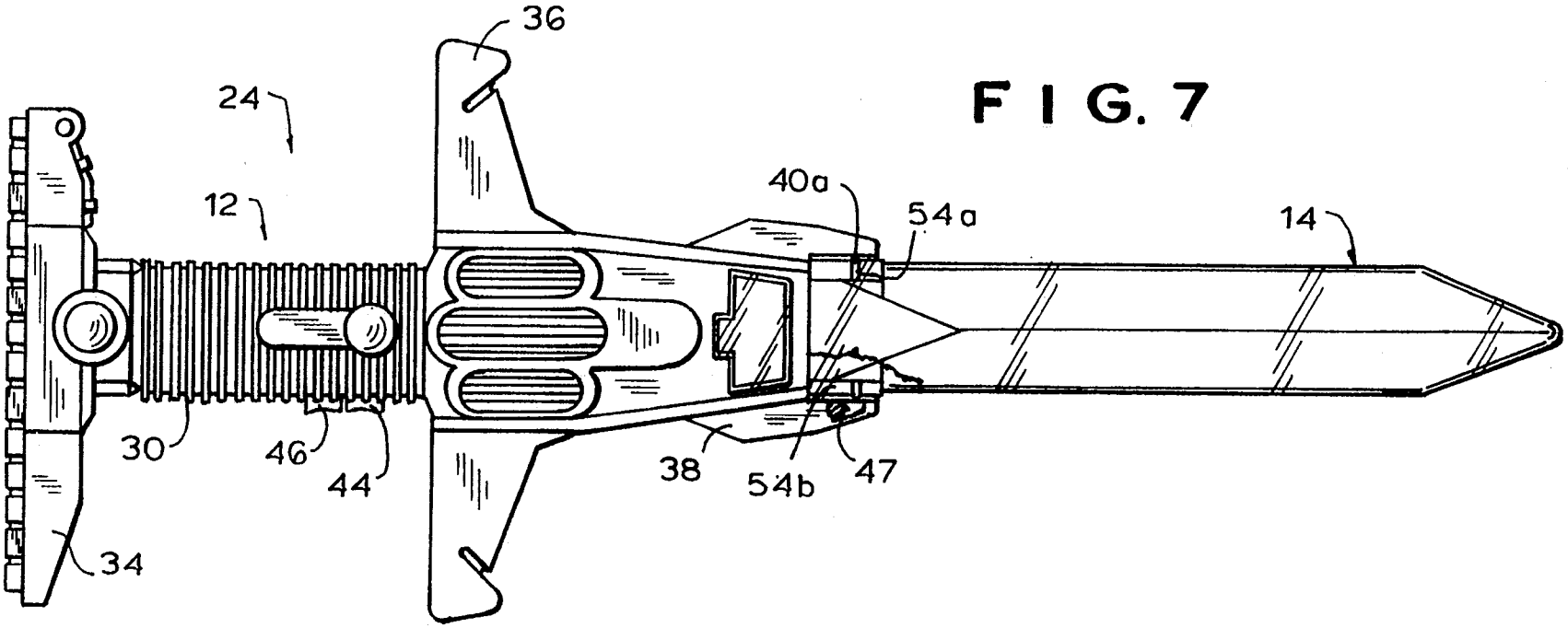
FIGS. 7–11 are side elevational, top plan, bottom plan, rear elevational and front elevational views, respectively, of a second toy weapon ("power sword") formed by combining the basic component and one additional component ("the sword conversion means"), with portions cut away in the side elevational view to reveal details of internal construction.
Figure 8:
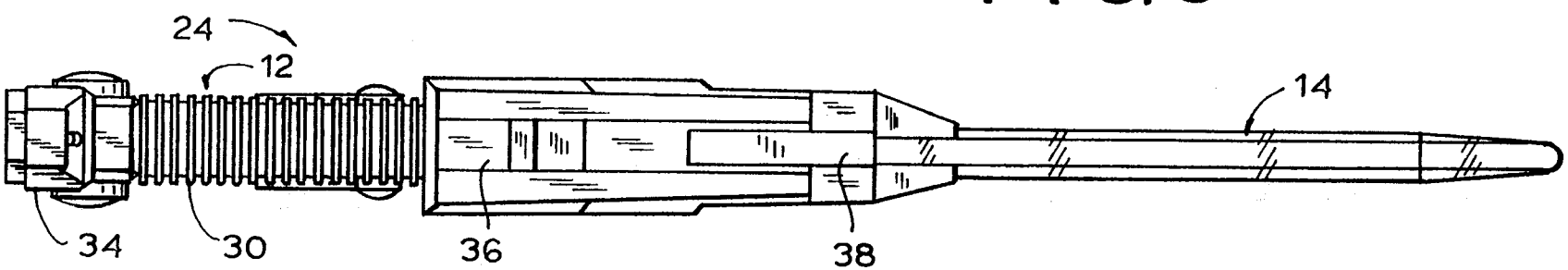
Figure 9:
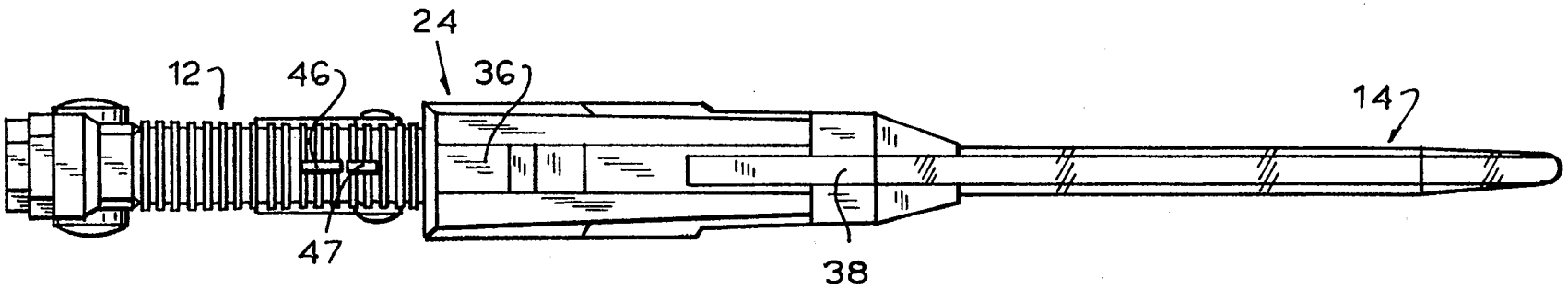
Figure 11:
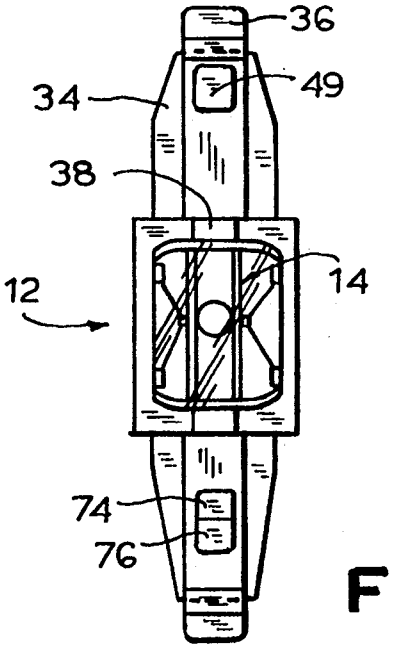
Figure 10:
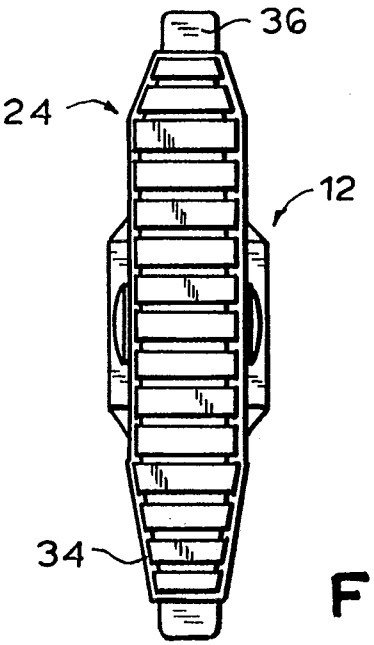
Figure 12:
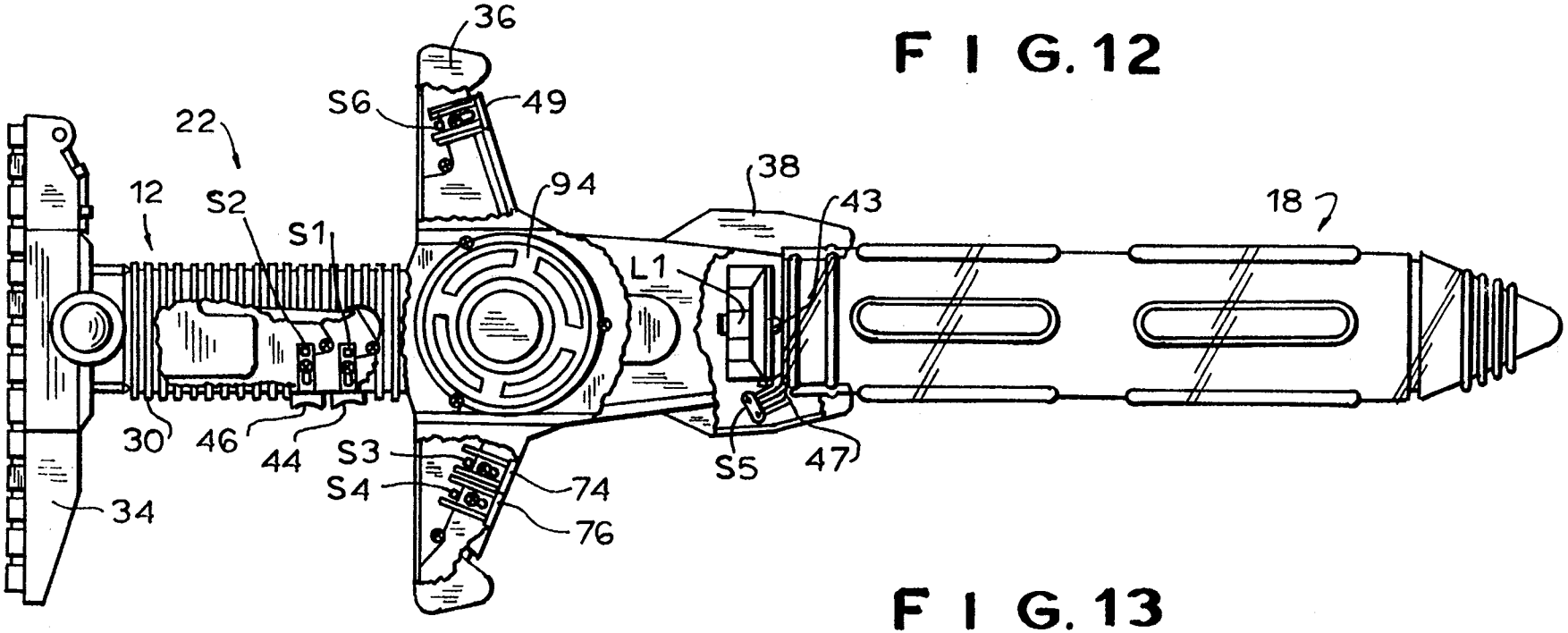
FIGS. 12–16 are side elevational, top plan, bottom plan, rear elevational and front elevational views, respectively, of a third toy weapon ("laser sword") formed by combining the basic component and a different additional component ("the tube conversion means"), with portions cut away in the side elevational view to reveal details of internal construction.
Figure 13:
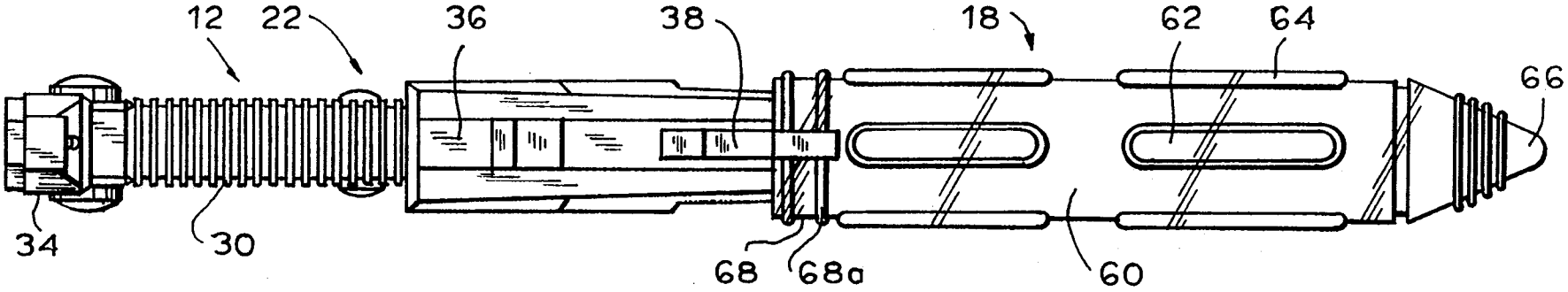
Figure 14:
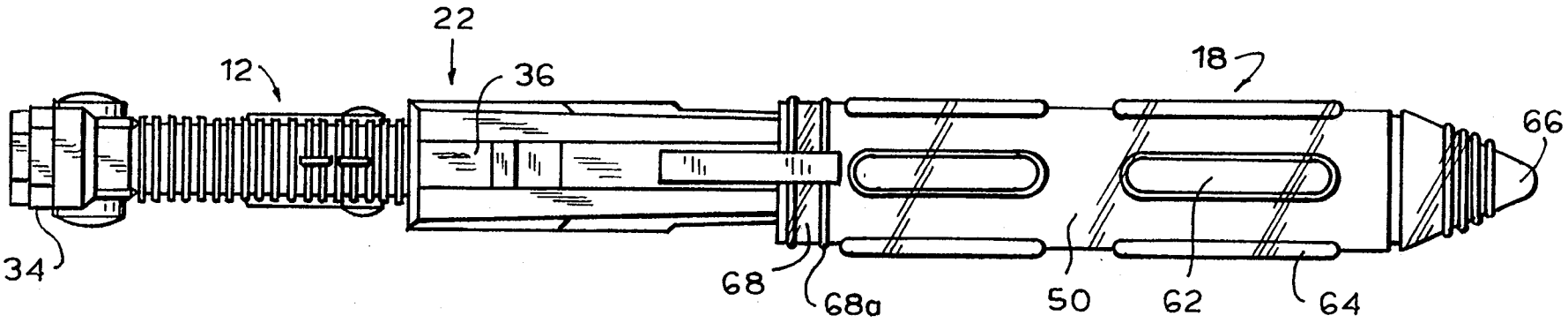
Figure 16:
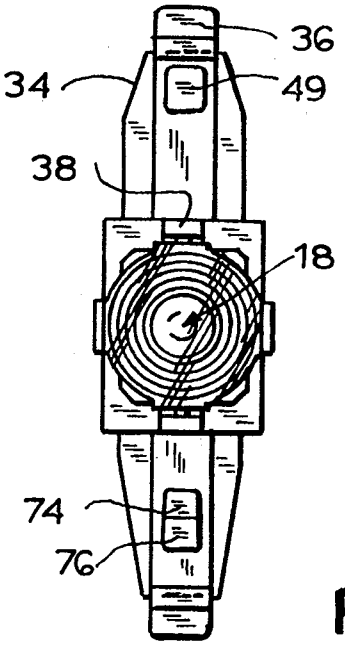
Figure 15:
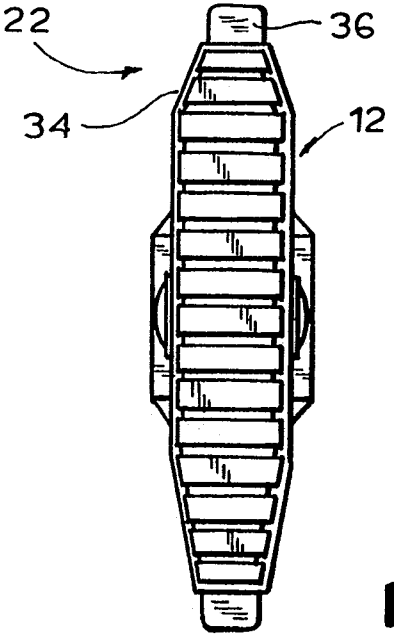
Figure 17:
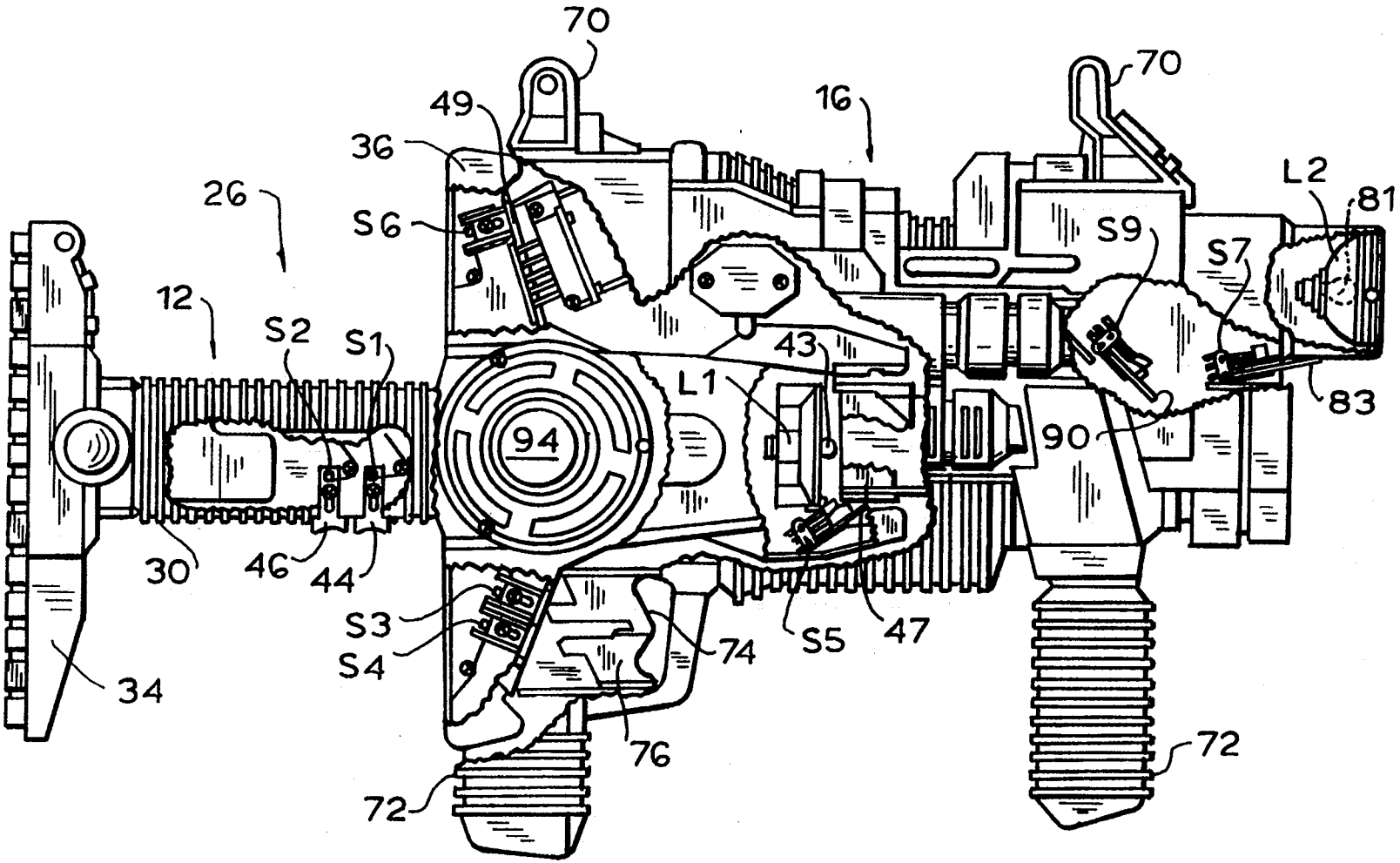
FIGS. 17–21 are side elevational, top plan, bottom plan, rear elevational and front elevational views, respectively, of a fourth toy weapon ("army machine gun") formed by combining the basic component and a still different additional component (the "machine gun conversion means"), with portions cut away in the side elevational view to reveal details of internal construction.
Figure 18:
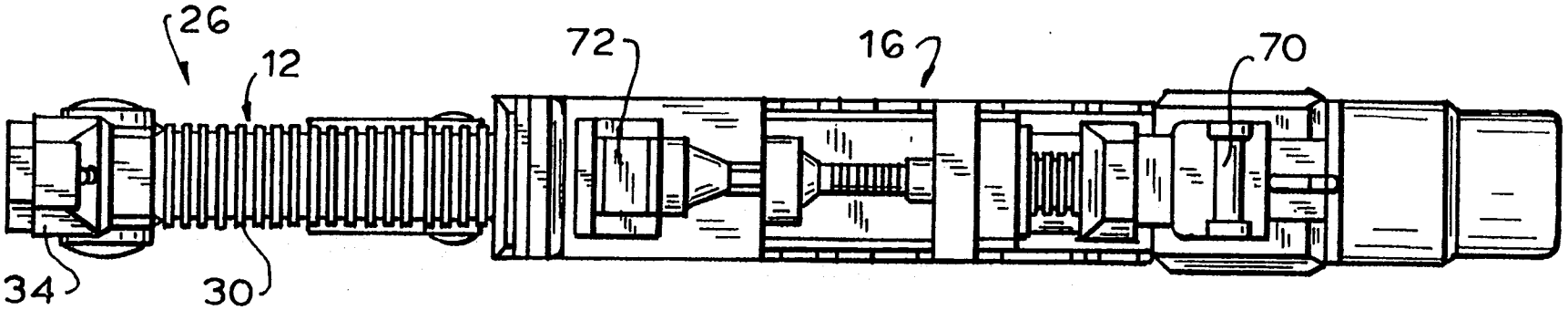
Figure 19:
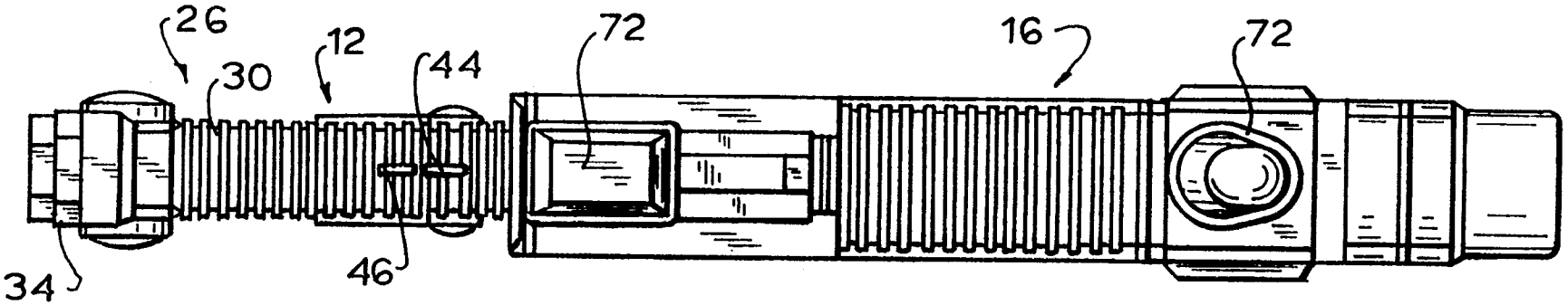
Figure 21:
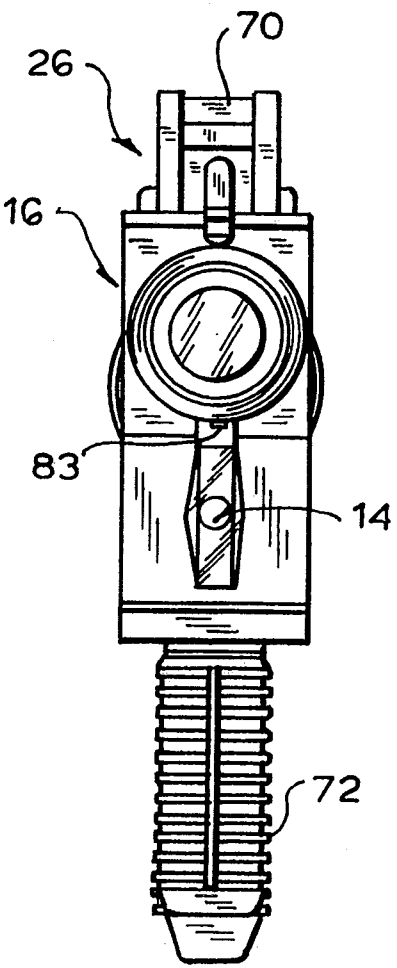
Figure 20:
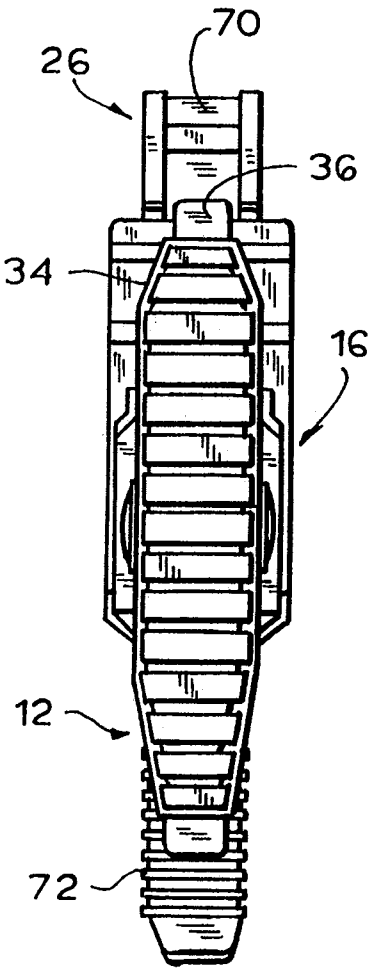
Figure 22:
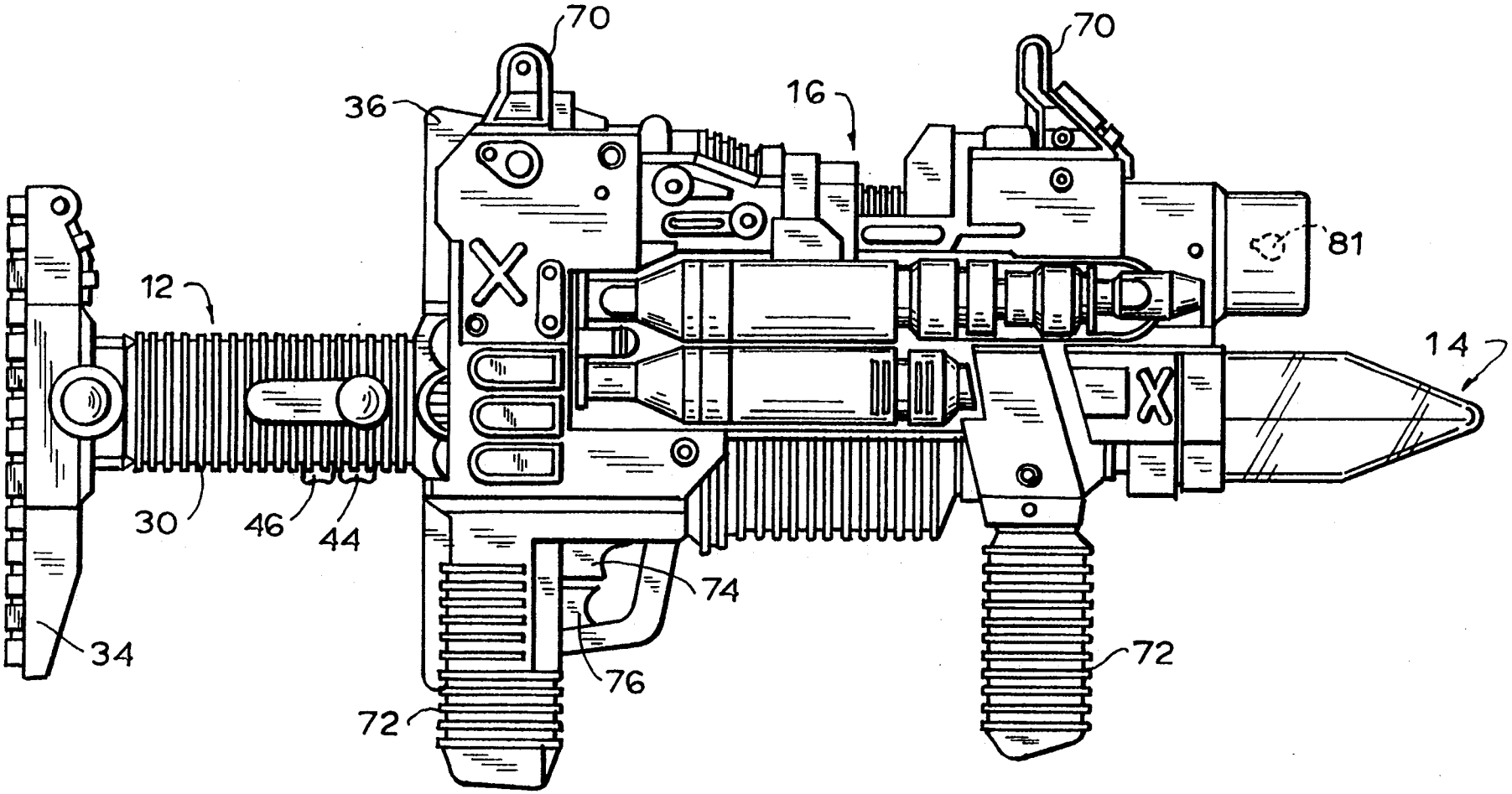
FIGS. 22–26 are side elevational, top plan, bottom plan, rear elevational and front elevational views, respectively, of a fifth toy weapon ("bayonet machine gun") formed by combining the basic component and two of the additional components (the machine gun and sword conversion means)
Figure 23:
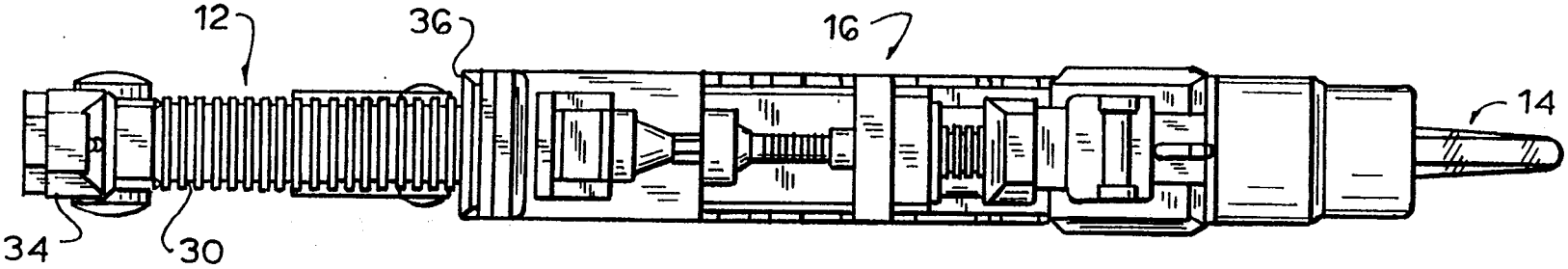
Figure 24:
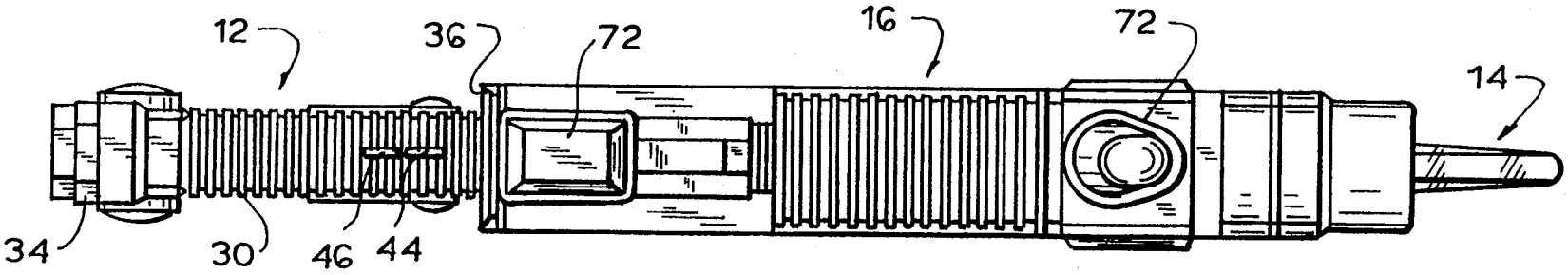
Figure 26:
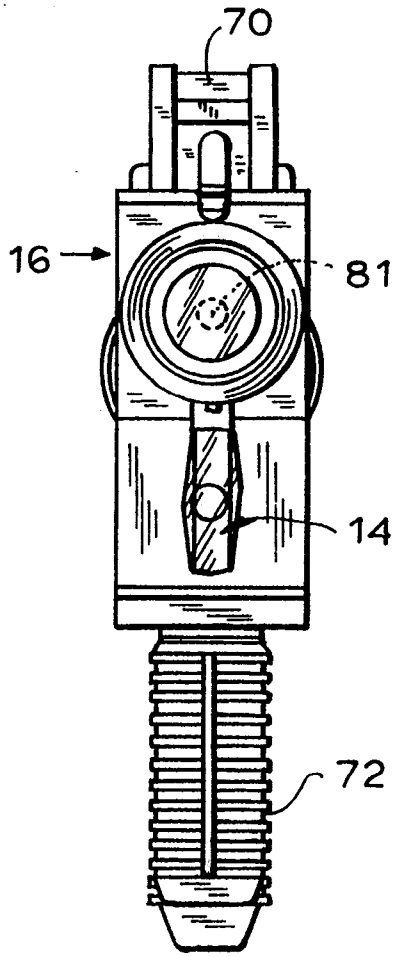
Figure 25:
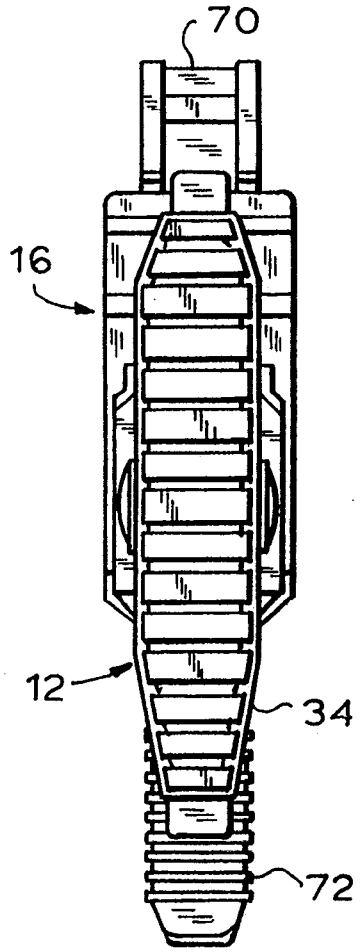
Figure 27:
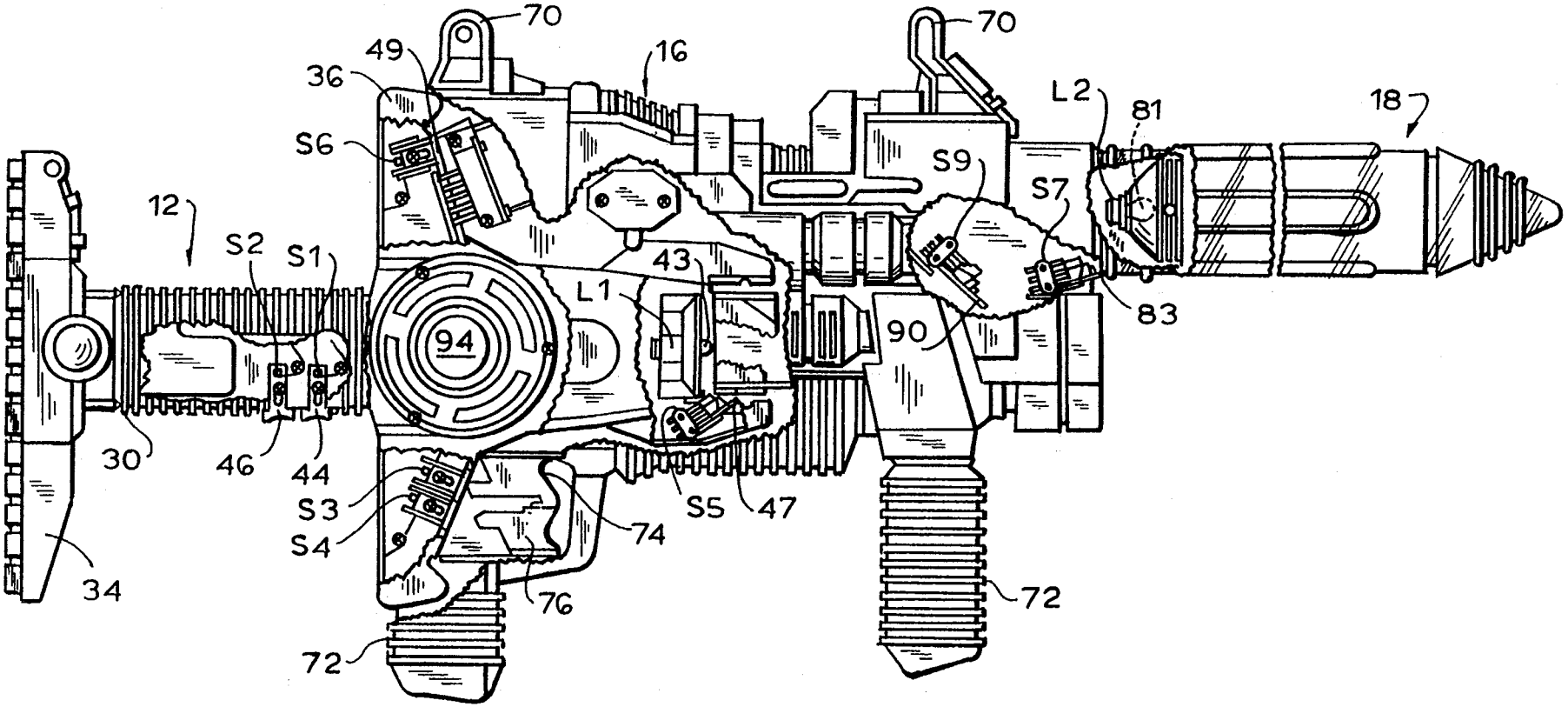
FIGS. 27–31 are side elevational, top plan, bottom plan, rear elevational and front elevational views, respectively, of a sixth toy weapon ("cyber gun") formed by combining the basic component and two of the additional additional components (the, machine gun and tube conversion means) with portions cut away in the side elevational view to reveal details of internal construction.
Figure 28:
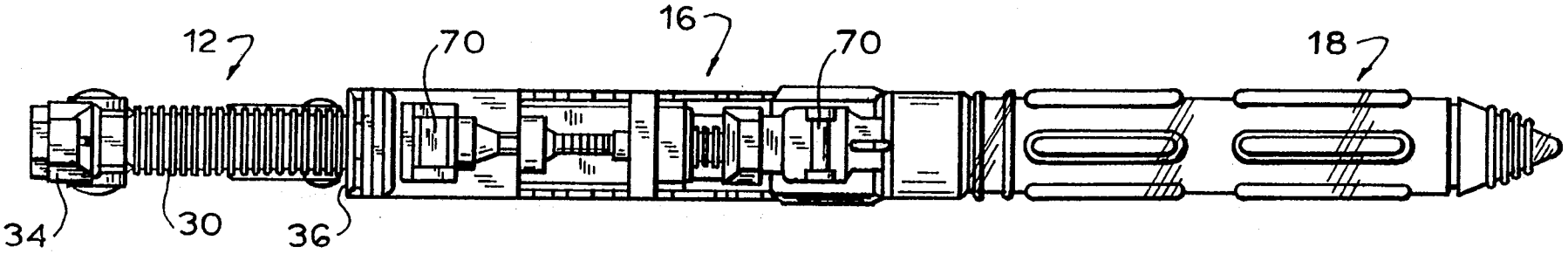
Figure 29:
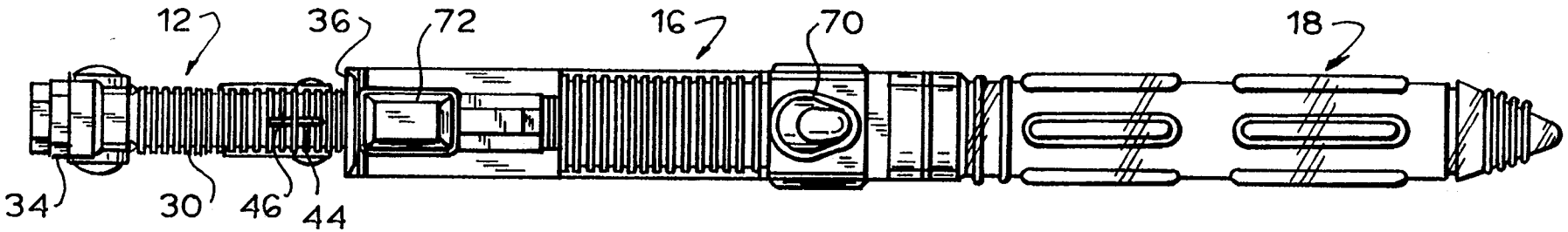
Figure 31:
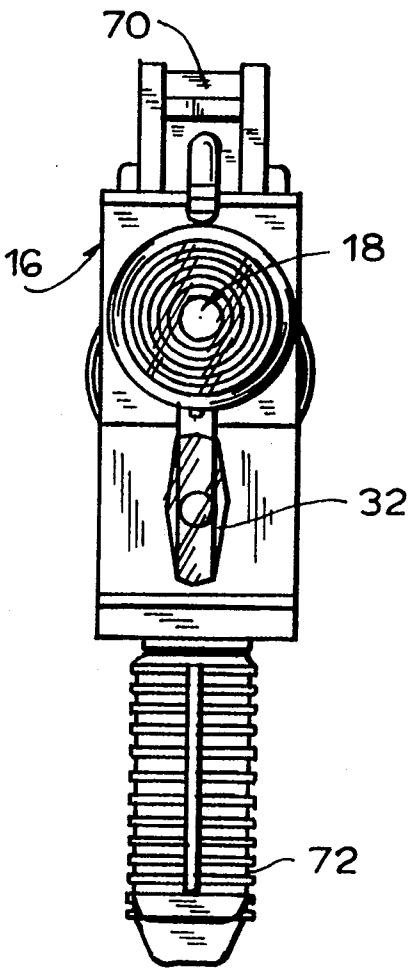
Figure 30:
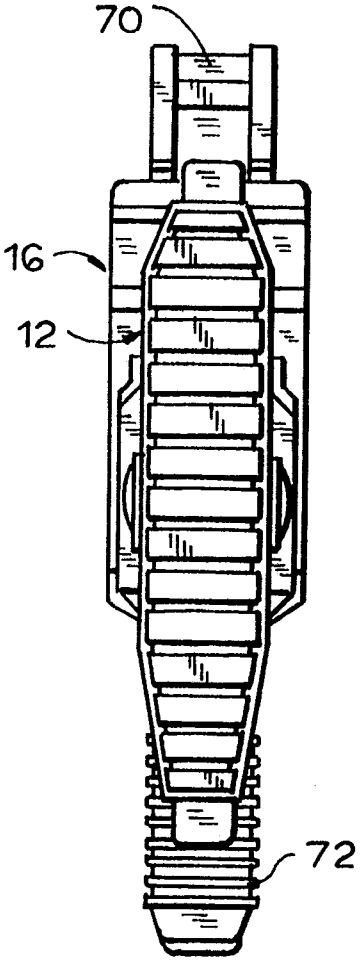
Figure 32:
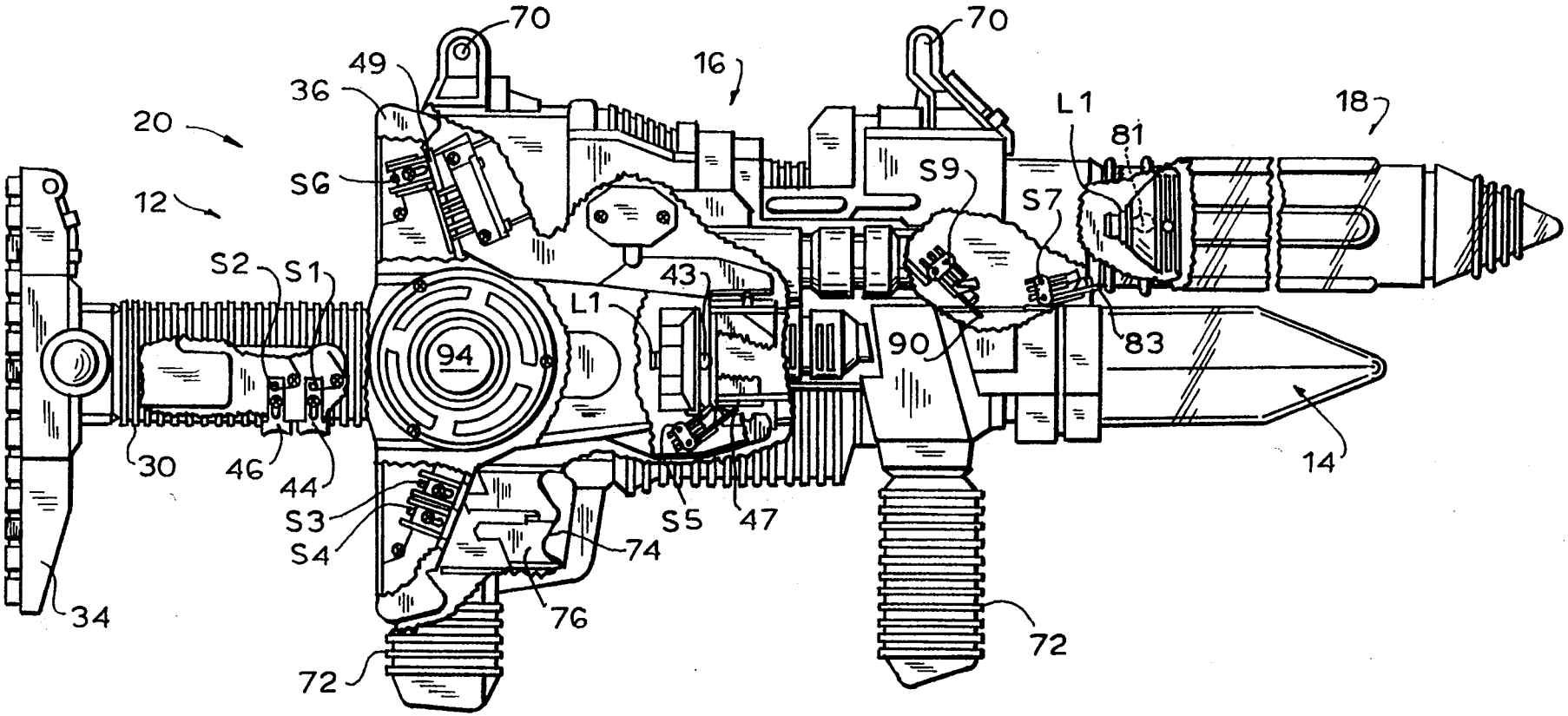
Figure 33:
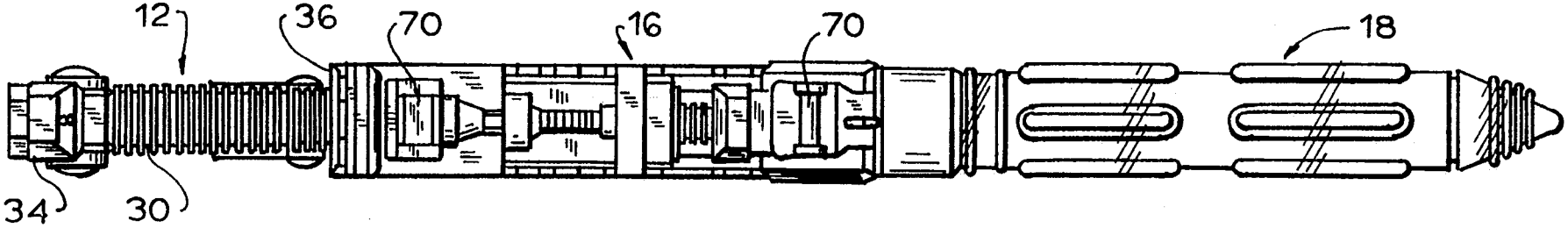
Figure 34:
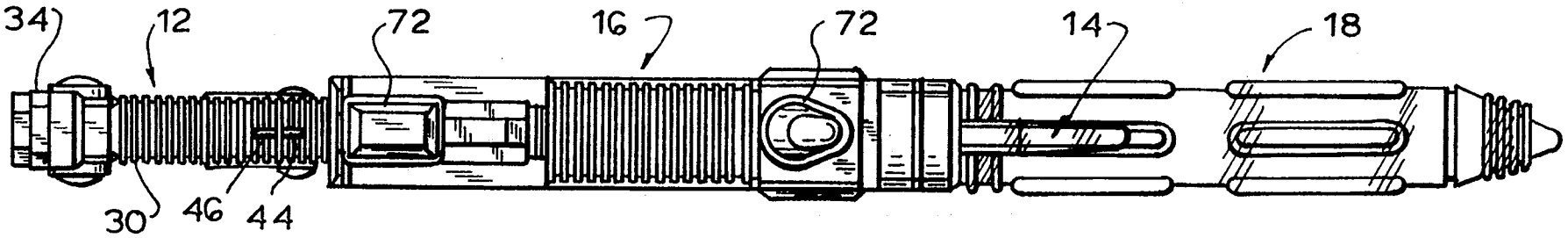
Figure 36:
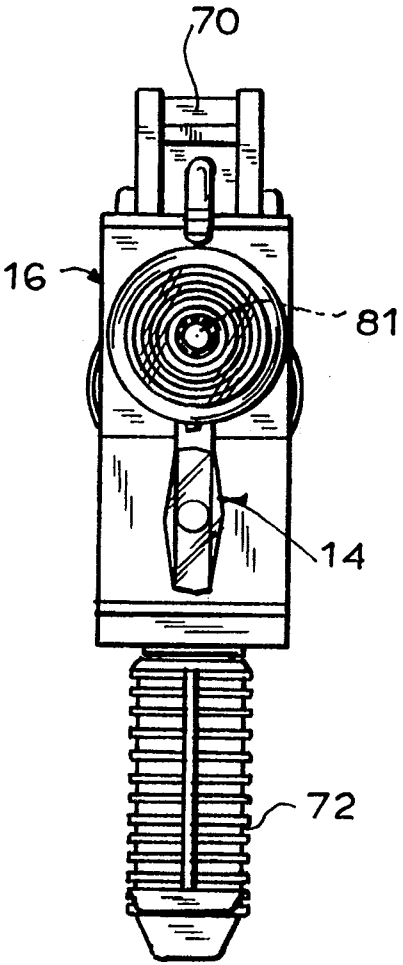
Figure 35:
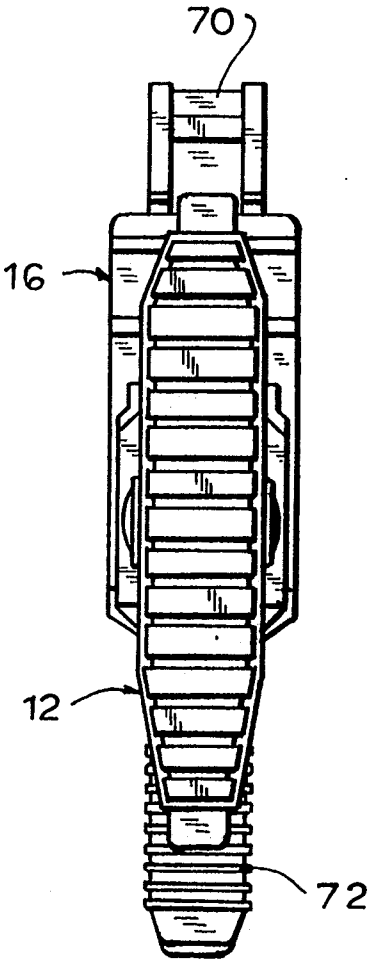

Referring now to the drawing, and in particular to FIGS. 1A and 1B, therein illustrated is a kit according to the present invention, generally designated by the reference numeral 10, for assembling a plurality of toy weapons. As illustrated, the kit 10 contains four components, although similar kits within the scope of the present invention may be formed having only three or more than four components. The four components include a basic weapon generally designated 12 having a first or "power dagger" configuration, and a first plurality of conversion means generally designated 14, 16 and 18, for converting the basic weapon 12 to a second plurality of different weapon configurations. The basic weapon 12 and each of the conversion means 14, 16, 18 are releasably securable together to form a second plurality of weapons, the second plurality of weapons being greater than the first plurality of conversion means. Two of the four components may be releasably joined together to form the "power sword," generally designated 24 (illustrated in FIGS. 7–11), the "laser sword," generally designated 22 (illustrated in FIGS. 12–16), or the "army machine gun," generally designated 26 (illustrated in FIGS. 17–21); and three of the four components may be releasably joined together to form either the "bayonet machine gun," generally designated 28 (illustrated in FIGS. 22–26 and 37), or the "cyber gun," generally designated 30 (illustrated in FIGS. 27–31); and all four components may be releasably joined together to form the "super weapon" generally designated 20 (illustrated in FIGS. 32–36).

More particularly, the power sword 24 (illustrated in FIGS. 7–11) is formed by a combination of the basic weapon 12 and the sword conversion means 14, the laser sword 22 (illustrated in FIGS. 12–16) is formed by a combination of the basic weapon or power dagger 12 and the tube conversion means 16, the "army machine gun" 26 (illustrated in FIGS. 17–21) is formed by a combination of the basic weapon 12 and the machine gun conversion means 16, the "bayonet machine gun" 28 (illustrated in FIGS. 22–26) is formed by a combination of the basic weapon 12, the machine gun conversion means 16, and the sword conversion means 14, and the "cyber gun" 30 (illustrated in FIGS. 27–31) is formed by a combination of the basic weapon 12, the machine gun conversion means 16, and the tube conversion means 18. As earlier noted, the "super weapon" 20 (illustrated in FIGS. 32–36) is formed from all four of the kit components: the basic weapon or "power dagger" 12, the sword conversion means 14, the machine gun conversion means 16, and the tube conversion means 18.

In more general terms, the three conversion means 14, 16, 18 enable the basic weapon 12 to be converted into six different weapons configurations by releasably securing together the basic weapon 12 and at least one of the conversion means 14, 16, 18 thereby to form different weapons. The number of weapons which can be thus formed (six) is clearly greater than the number of conversion means (three). This is made possible because one conversion means is directly releasably securable together with another conversion means, thereby to form with the basic weapon a third weapon different from both the basic weapon and any combination of the basic weapon and one of the conversion means. In other words, there is the possibility of forming three and four component weapons such as the bayonet machine gun 28, the cyber gun 30 and the super weapon 20. Accordingly, at least six different weapons can be formed from the basic weapon 12 and the three conversion means 14, 16, 18 provided in the kit. It will be appreciated that in a kit comprised of only three components—namely, the basic weapon 12, the machine gun conversion means 16, and one of the other conversion means 14 or 18, the three components provided could be releasably joined together to form at least three weapons (not including the basic weapon by itself).

Viewed another way, the great diversity in weapon configurations attainable with the components of a kit according to the present invention results from at least one of the conversion means being releasably securable to the basic weapon in one weapon configuration and to another conversion means in another weapon configuration.

As will be appreciated by those familiar with the toy weapon art, the particular features of the several components 12–18 of the kit 10 are, for the most part, cosmetic and intended to increase the appeal of the toy to its intended market (typically children) but are not functional and play no functional role except to enhance the play value of the kit.

The basic weapon 12 is in the configuration of a "power dagger" and includes a handle 30 and a blade 32. The handle 30 is adapted to be grasped by a child's hand and is provided with a rear guard 34 extending upwardly and downwardly therefrom and a front guard 36 also extending upwardly and downwardly therefrom, for "protection" of the hand. The blade 32 includes a blade guard 33 which defines with blade 32 a forwardly opening slot 36 both at the top thereof and at the bottom thereof, the blade guard 33 being similar to guards found on some real swords in order to define slots 36 for capturing (and hopefully breaking) the opponent's blade.

In the illustrated electric version of the power dagger 12, a portion **34*a* of the rear handle guard 34 is removable to enable access to a battery compartment 41, and a portion 42 of the power dagger 12 adjacent the blade guard 38 is transparent or translucent to permit a light-generating means, such as a bulb 43, disposed therebelow and powered by the batteries, to shine therethrough. Additionally, the handle 30 is provided with at least one and preferably multiple triggers 44, 46 (two being illustrated and corresponding to electrical switches S3 and S4 of FIG. 38) for causing sound to be generated and the bulb 43 to be illuminated. While the triggers 44, 46 are illustrated as disposed on the handle 30 of the power dagger 12, alternatively they may be disposed elsewhere (for example, on the back of the forward handle guard 36), provided the site is easily accessible by the user of the weapon. Additionally, while the two triggers 44, 46** are shown as being closely adjacent, and indeed contiguous, alternatively they may be disposed in spaced relationship to one another. As will be explained in further detail hereinafter, actuation of each of the triggers may result in a different sound being produced.

The electric version of the power dagger 12 additionally includes a lever 47 pivotably secured thereto and normally disposed within one of the forwardly opening slots 36. The lever is pivotable out of slot 36, such movement acting to close normally open switch S5 of FIG. 38 to affect the sound-generating means, as will be described hereinafter in greater detail.

Turning now to each of the conversion means 14, 16, 18, separately, the sword conversion means 14 is hollow and preferably transparent or translucent. It has a body portion 50 of elongate polygonal configuration resembling the body of a sword. The body 50 terminates at the forward end in a pointed tip 52 and at the rear end in a base 54 having an outwardly projecting rim 54*a* and slots 54*b*. The base 54 is configured and dimensioned to enter into the slot 40 of the power dagger 12, with the projecting rim 54*a* interlocking with the groove 40*a* in slot 40, thereby to releasably secure the sword conversion means 14 to the power dagger 12 against accidental displacement, while still permitting intentional disengagement. The power sword 24, formed by the combination of the power dagger 12 and the sword conversion means 14, is illustrated in FIGS. 7–11.

The tube conversion means 18 represents a futuristic or space-age component. It is hollow and preferably transparent or translucent, with a cylindrical body 60 defining apertures 62 therein and ridges 64 thereon. The cylindrical body 60 terminates at the forward end in a pointed tip 66 and at the rear end in a base 68 having an outwardly projecting rim 68*a*. The base 68 of the tube conversion means 18 is configured and dimensioned to enter into the slot 40 of the power dagger 12, with the projecting rim 68*a* interlocking with the groove 40*a*, thereby to releasably secure the tube conversion means 18 to the power dagger 12 against accidental displacement while still permitting intentional disengagement. The laser sword 22, formed by the combination of the power dagger 12 and the tube conversion means 18, is illustrated in FIGS. 12–16.

Unlike the power dagger 12, neither the sword conversion means 14 or the tube conversion means 18 contains any electric or electronic circuitry. While the sword conversion means 14 is mountable only on the power dagger 12, however, the tube conversion means 18 is mountable on either the power dagger 12, as already described, or on another conversion means, as will be explained hereinafter.

In the electrical version of the device illustrated, the mounting of the sword conversion means 14 on the power dagger 12 does not affect the status of switch S5 because the slots 54*b* on the base of the sword conversion means 14 are so disposed that the base 54 does not contact the lever 47. By way of contrast, the tube conversion means 18 has no such slots on the base 68 thereof. Accordingly, when the tube conversion means 18 is mounted on the power dagger 12, it cams lever 47 and thereby actuates (i.e., closes) normally open electrical switch S5 of FIG. 38. The power dagger 12 additionally includes on a front surface of the front handle guard 36 an outwardly biased button 49 which, when depressed, actuates normally open electrical switch S6 of FIG. 38.

The machine gun conversion means 16 is hollow and configured so that, in combination with the power dagger 12, the assembly resembles somewhat a portable army machine gun. Among the various design or ornamental features of the machine gun conversion means are front and rear sights 70, front and rear hand grips 72, and the like. The forward end 80 of the machine gun conversion means 16 is configured and dimensioned to enable the base 68 of the tube conversion means 18 to be removably mounted thereon, for example, by a friction fit.

The back end 84 of the machine gun conversion means 16 defines an aperture leading into the chamber or hollow thereof. The chamber is configured and dimensioned to receive therein the blade 32 of the power dagger 12 all the way up to the rear face of the forward guard means 36, thereby to form the army machine gun 26 (illustrated in FIGS. 17–21). It will be appreciated that the machine gun conversion means 16 can receive the power dagger 12, either by itself or with the sword conversion means 14 attached thereto to form the power sword 24. When the machine gun conversion means 16 receives the power sword 24, it forms the bayonet machine gun 28 (illustrated in FIGS. 22–26) as the forward tip 52 and a portion of the body 50 of the sword conversion means 14 extend through an aperture 86 in the front of the machine gun conversion means 16 below the forward end 80 thereof.

Thus, when the machine gun conversion means 16 receives the power dagger 12 alone, it forms the army machine gun 26 (illustrated in FIGS. 17–21) and, when it receives the power sword 24, it forms the bayonet machine gun 28 (illustrated in FIGS. 22–26). When the machine gun conversion means 16 receives the power dagger 12 therein and the tube conversion means 18 is also mounted on the forward end 80 of the machine gun conversion means 16, it forms the cyber gun 30 (illustrated in FIGS. 27–31). When the machine gun conversion means 16 receives the power sword 24 therethrough and the tube conversion means 18 is also mounted on the forward end 80 of the machine gun conversion means 16, it forms the super weapon 20 (illustrated in FIGS. 32–36).

It will be appreciated that, unlike the sword conversion means 14, which only extends the length of the blade 32 of the power dagger 12 or the tube conversion means 18 which only extends the length of and superficially modifies the blade 32 of the power dagger 12, the machine gun conversion means 16 substantially conceals and converts the identity and essential appearance of the basic weapon 12 or power sword 24. Indeed, only the body 30 and rear handle guard 34 of the power dagger 12 remain visible when the machine gun conversion means 16 is mounted thereon. The situation is the same when the machine gun conversion means 16 is mounted on the power sword 24, the only difference being that the forward end 52 and a small segment of the body portion 50 of the sword conversion means 14 are also visible in front of the machine gun conversion means 16. Thus the machine gun conversion means 16 substantially changes the character of the weapon on which it is mounted.

Figure 38:
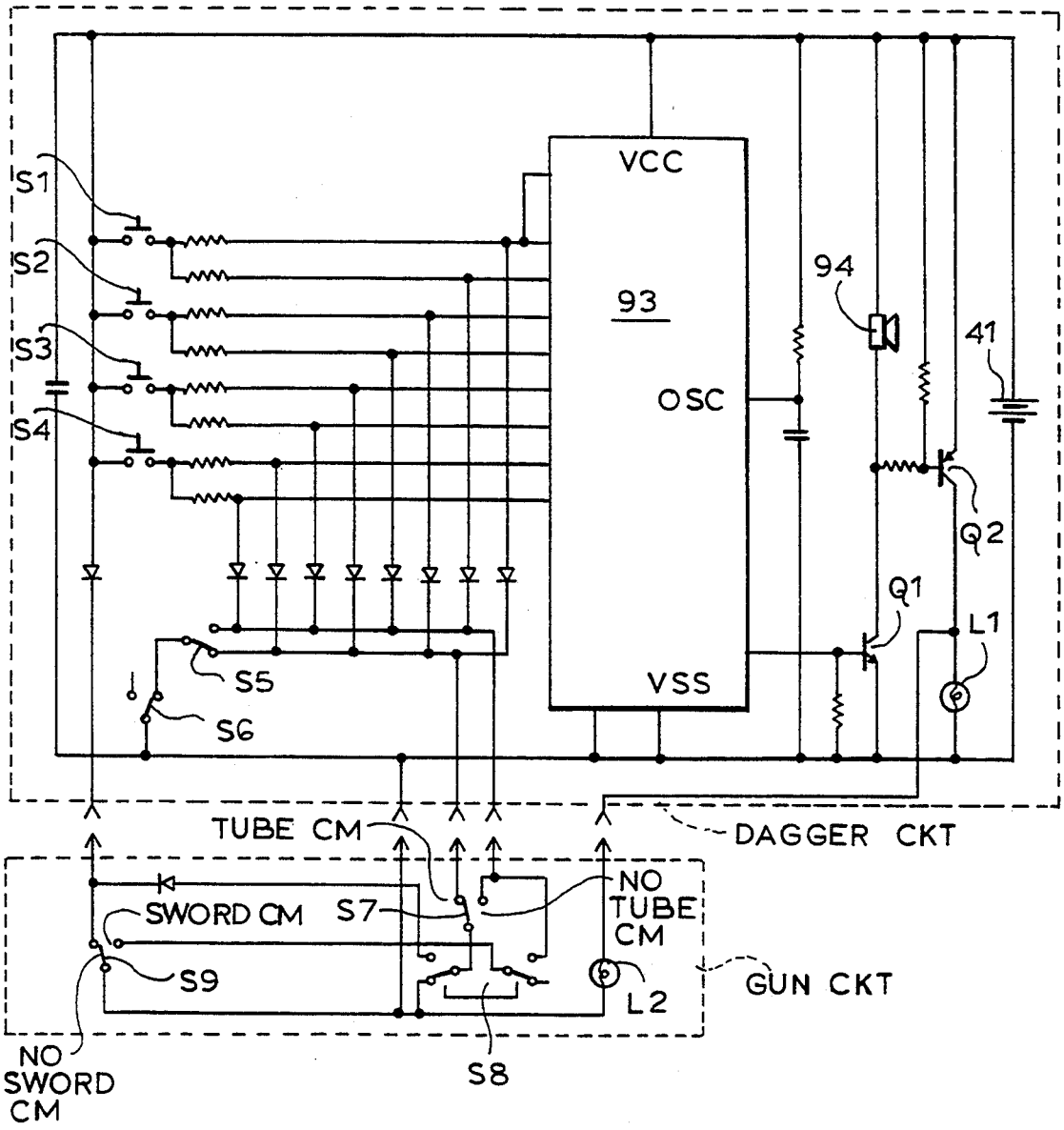
FIG. 38 is an electrical schematic of the toy weapon.

In an electrical embodiment of the machine gun conversion means 16, at least one and preferably multiple triggers 74, 76 are provided (two being illustrated and corresponding to electrical switches S1 and S2 of FIG. 38). The transparent front end 80 is cylindrical and resembles a gun barrel. It contains a light-generating means, such as a bulb 81, and is transparent so that, when actuated, the light-generating means is 81 is visible therethrough. Additionally, a physical slide switch 82 corresponding to a double pole, double throw electrical switch S8 is provided for reasons to be described hereinafter.

Further, the back end 84 of the machine gun conversion means 16 additionally includes a rearwardly facing protrusion 84*a* which is positioned so that, when the machine gun conversion means 16 is mounted on the power dagger 12, protrusion 84*a* depresses normally raised button 49 on the power dagger handle forward guard 36, thereby actuating normally open electrical switch S6 of FIG. 38 and indicating to the circuitry of the power dagger 12 the presence of the machine gun conversion means 16 in the weapon.

Additionally, a lever is provided within the chamber of the machine gun conversion means 16, the lever 90 being disposed adjacent the forward end of the chamber for contact with the sword conversion means 14 when the power sword 24 is inserted into the machine gun conversion means 16, thereby to form either the bayonet machine gun 28 or the super weapon 20. The sword conversion means 14 cams the lever 90 upwardly, thereby actuating (i.e., closing) a corresponding normally open electrical switch S9 of FIG. 38.

In the electrical embodiment of the machine gun conversion means 16, a lever 83 is pivotally disposed adjacent the forward end 80 externally of the circumference thereof. The circumference of the forward end 80 defines an aperture 80*a* through which the lever 83 can be pivoted inwardly. The lever 83 is biased outwardly of aperture 80*a*, but the exposed front and outer surface curvature of the lever 83 is configured and dimensioned such that, as the base 68 of the tube conversion means 18 is pushed onto the outer surface of the forward end 80 of the machine gun conversion means 16, the lever 83 is cammed inwardly, retreating within the aperture 80*a*. The movement of lever 83 actuates (i.e., closes) normally open electrical switch S7 of FIG. 38 to affect the sound-generating means, as will be described hereinafter in greater detail.

In the electrical embodiment, when the machine gun conversion means 16 is mounted on the power dagger 12, contacts 86 disposed on a forward surface of the upper portion of the forward handle guard 36 of the power dagger 12 are in electrical communication with contact means 88 disposed adjacent the back end 84 of the machine gun conversion means 16. Thus, while the machine conversion means 16 does not itself carry a power supply or a sound-generating mechanism like the basic weapon 12, it contains circuitry which can affect the sounds to be generated by the sound-generating mechanism of the basic weapon 12.

The sounds made by the sound-generating means will vary according to the configuration of the weapon formed, the triggers depressed, and, in the super weapon configuration only, the position of switch 82 (corresponding to electrical switch S8 of FIG. 38). For both the power dagger 12 and power sword 24, actuation of handle trigger 44 or 46 (corresponding to electrical switches S3 and 84 of FIG. 38) results in ordinary sword sounds TG7 or TG5 being produced (e.g., swords being drawn or unsheathed "zing," or swords clashing "swish" or "clang"), the sounds differing for each handle trigger 44, 46.

When the tube conversion means 16 is mounted on the power dagger 12, thereby to form the laser sword 22, so that the base 68 of the tube conversion means 18 actuates switch 83 (corresponding to electrical switch S7 of FIG. 38) and thereby modifies the sound-generating means so that space sword sounds TG6 or TG8 (e.g., "room" or "zap") are produced upon actuation of either of handle triggers 44 or 46 (corresponding to electrical switches S3 and S4 of FIG. 38), the sounds differing for each trigger 44, 46.

When the machine gun conversion means 16 is mounted on the power dagger 12 (so that button 49 is depressed and electrical switch S6 of FIG. 38 is activated)—without the sword conversion means 14 also being mounted on the power dagger 12 or the tube conversion moves 18 also being mounted on the machine gun conversion means 16—thereby to form the army machine gun 26 of FIGS. 17–21, handle triggers 44, 46 are deactuated as there is no need to produce any sword sounds. In this case, only the machine gun triggers 74, 76 are active, and these produce ordinary gun sounds TG1 or TG3 (e.g., machine guns shooting or grenades being launched) when activated.

When both the machine gun conversion means 16 and the sword conversion means 14 both are mounted on the power dagger 12 (so that lever 90 is retracted and normally open electrical switch S9 of FIG. 38 is activated as well as electrical switch S6 of FIG. 38)—without the tube conversion means 18 being present—thereby to form the bayonet machine gun 28 of FIGS. 22–26, then all four triggers 44, 46, 74, 76 are active, with triggers 44 and 46 making ordinary sword sounds TG5, TG7 and triggers 74, 76 making ordinary gun sounds TG1, TG3. This is appropriate since the bayonet machine gun 28 includes both an element which shoots (the machine gun conversion means 16) and sword-like elements (the sword conversion means 14).

However, when the machine gun conversion means 16 is mounted on the power dagger 12 and the tube conversion means 18 is mounted on the machine gun conversion means 16 so that lever 83 is moved and corresponding electrical switch S7 of FIG. 38 is activated as well as electrical switch S6 of FIG. 38—without the sword conversion means 14 being present—thereby to form the cyber gun 30 of FIGS. 27–31, then handle triggers 44, 46 are deactuated and space gun sounds TG2 or TG4 (e.g., laser gun sounds or photon torpedo sounds) are produced upon actuation of machine gun triggers 74, 76, the sounds differing for each trigger 74, 76.

When the machine gun conversion means 16 is mounted on the power dagger 12 (so that button 49 is depressed and electrical switch S6 of FIG. 38 is actuated), with both the tube conversion means 18 (so that lever 83 is moved and electrical switch S7 of FIG. 38 is actuated) and the sword conversion means 14 (so that switch lever 90 is moved and electrical switch S9 of FIG. 38 is actuated), thereby to form the super weapon of FIGS. 32–36, then all four triggers 44, 46, 74, 76 are active and, when actuated, make different sounds. In this super weapon configuration, and only in this configuration, the different ordinary sword sounds TG5, TG7 and ordinary gun sounds TG1, TG3 produced upon actuation of triggers 44, 46, 74, 76 may be changed to the different set of futuristic space sword sounds TG6, TG8 and futuristic space gun sounds TG2, TG4 by resetting switch 82. It is only in the bayonet machine gun 28 and the super weapon 20 that all four manually operable triggers 44, 46, 74, are active.

Thus, depending upon the weapon configuration used, different triggers may or may not be activatable to produce sounds appropriate to the particular weapon configuration. Except in the super weapon configuration 20, the presence of the sword conversion means 14 causes actuation of handle triggers 44, 46 to produce ordinary sword sounds appropriate for the presence of a sword. The presence of the tube conversion means 18 represents a futuristic or space age device. As appropriate for a futuristic device, in the laser sword configuration 22 it causes actuation of handle triggers 44, 46 to make space sword sounds, and in the cyber gun configuration 30, it deactivates handle triggers 44, 46 and causes actuation of machine gun triggers 74, 76 to make space gun sounds; and in the super weapon configuration 20, it causes all triggers 44, 46, 74, 76 to be active and to make different sounds depending on the status of slide switch 82 (corresponding to electrical switch S8 of FIG. 38).

Referring now to FIG. 38, therein illustrated is the electrical circuitry of the power dagger 12 and the machine gun conversion means 16, all of the circuitry indicated being found in the power dagger 12 except for that within the boundaries of the dashed line, which represents the circuitry found in the machine gun conversion means 16. The circuitry includes nine electrical switches: four of these electrical switches S1–S4 representing manually operated triggers 74, 76, 44, 46, respectively; another four of the electrical switches, S5–S7 and S9 represent non-manually operated switches 47, 49, 83 and 90, respectively, which indicate to the circuitry the weapon configuration at a given instant (S5: lever 47 indicating whether the tube conversion means 18 is present on the power dagger 12; S6: button 49 indicating whether the machine/gun conversion means 16 is present on the power dagger 12; S7: lever 83 indicating whether the tube conversion means 18 is present on the machine gun conversion means 17; and S9: lever 90 indicating whether the sword conversion means 14 is present on the machine gun conversion means 16); and a final electrical switch S8, indicating to the circuitry the status of a manually operable sound selection switch 82 on the machine gun conversion means 16. The circuitry additionally includes a pair of light-generating means L1 and L2 representing bulbs 43 and 81. Finally, the circuitry includes a speaker which responds to a sound-generating means capable of producing eight sounds as follows: TG1, an ordinary machine gun sound; TG2, a laser gun sound (a futuristic gun sound); TG3, a grenade launch (another ordinary machine gun sound); TG4, a photon torpedo (another futuristic gun sound); TG5, a sword zing (an ordinary sword sound, such as a sword unsheathing); TG6, a sword voom or hum (a futuristic sword sound); TG7, a sword clang or swish (another ordinary sword sound); and TG8, a sword zap or clash (another futuristic sword sound). Clearly, the sounds may be varied without departing from the principles of the present invention.

The sound-generating means 93 is a conventional digital voice RAM or like sound-producing chip including a positive power supply terminal VCC and a negative power supply terminal VSS. The terminals VCC, VSS are powered by the batteries within compartment 41. The chip additionally includes an oscillator output OSC and a voltage output VO. The oscillator OSC and voltage output VO drive a speaker 94 via transistor Q2.

The light-generating means L1 representing the bulb 43 within the power dagger 12 and the light-generating means L2 representing bulb 81 within the machine gun conversion means 16 are operated via transistor Q1 so as to produce light in synchronous relationship with the speaker circuit, so that light and sound are produced together to provide a realistic effect;

Depending on the sound generation desired, the actuation of a given trigger 44, 46, 74, 76 may result in the generation of sound either only once for each actuation of the trigger or for as long as the trigger is actuated. Typically, sound is generated only once for each trigger actuation, except for the ordinary machine gun sounds TG1.

While the present invention has been described in terms of a non-electrical embodiment wherein actuation of the various triggers has no effect, and a working electrical embodiment wherein actuation of the triggers results in the generation of both sound and light, clearly there are a variety of possible alternatives intermediate these extreme embodiments. For example, in an electrical embodiment, either sound or light (as opposed to both sound and light) may be generated in response to actuation of the triggers. Also, in a non-electrical embodiment, operation of the triggers may mechanically (as opposed to electrically) produce light and/or sound effects (for example, mechanically produced sounds and frictionally generated sparks). Additionally, in both the non-electrical and the electrical embodiments, additional working mechanisms may be incorporated, such mechanisms being responsive to actuation of one of the aforementioned triggers or additional triggers or like operating means. Thus, one or more of the several components of the gun may include one of the well known conventional mechanisms employing manual force, air pressure, biasing means, or the like to project outwardly from the toy weapon soft or rigid balls, missiles, projectiles, and the like, or even water, so that the toy weapon in one or more configurations incorporates air gun, water gun, nerf gun, or like capabilities. By way of example, the tube conversion means may include a supply of projectiles, balls, water or the like to be projected forwardly from one or more of the toy weapon configurations.

The kit 10 according to the present invention may be sold as either the several components separated from one another or a single toy weapon formed of the several components (for example, as the super weapon 20) and adapted to be optionally broken down into the several components.

Figure 37:
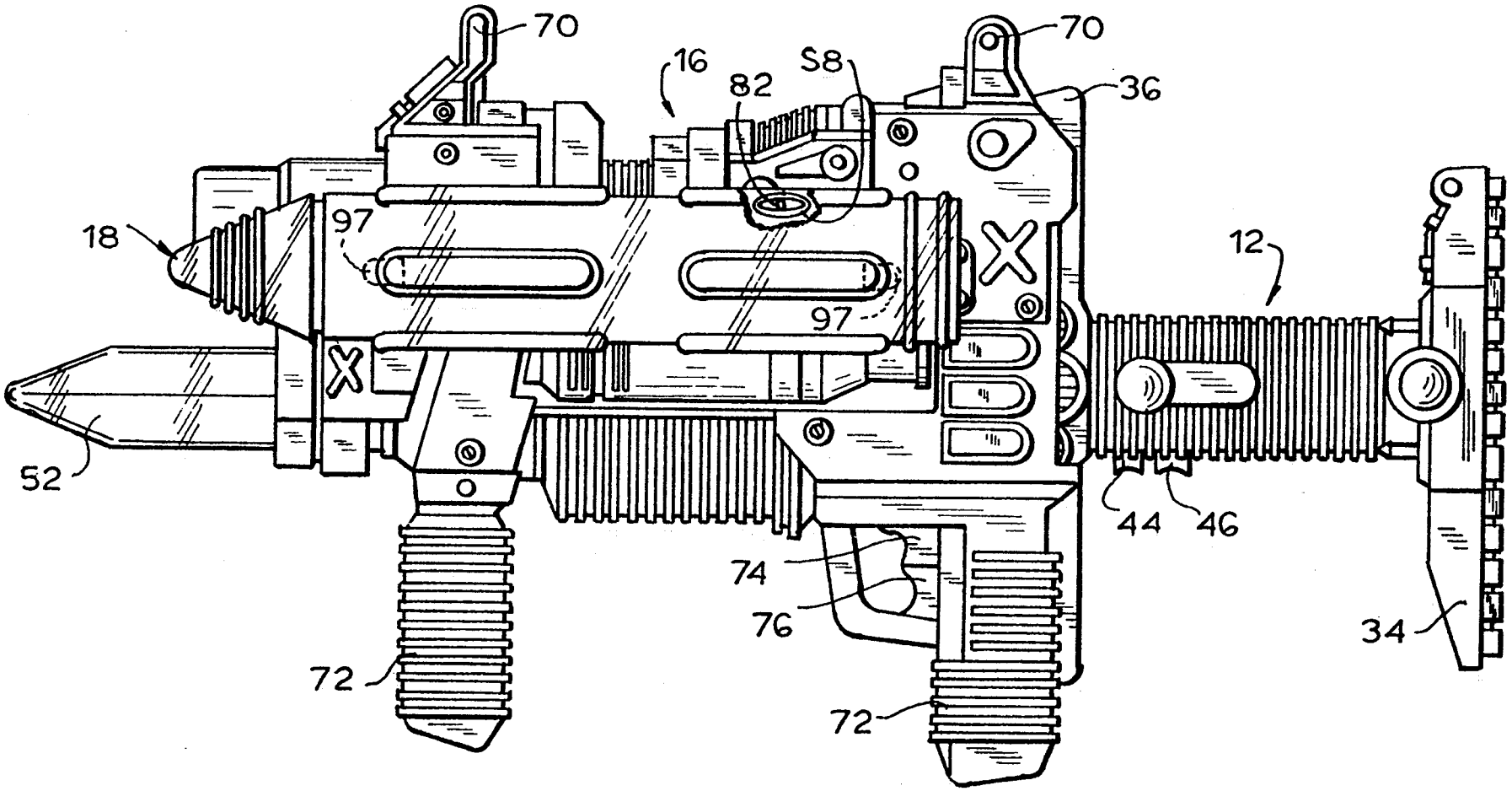
FIG. 37 is a side elevational view of the toy weapon in FIGS. 22–26 (the bayonet machine gun) having the remaining additional component (the tube conversion means) removably secured to one side thereof.

In order to prevent the loss of individual components when the toy weapon formulated from the kit contains less than all of the components thereof, means may be provided in or on one of the larger components for conveniently storing the unused components. Thus, as illustrated in FIG. 37, the machine gun conversion means 16 contains hook means 97 (see FIG. 1B.) for releasably engaging and retaining against accidental displacement the tube conversion means 18. Accordingly, when the toy weapon is being used in the army machine gun configuration 26 or the bayonet machine gun configuration 28, the tube conversion means 18 may conveniently be stored on one side of the machine gun conversion means 16 as illustrated. If desired, the sword conversion means 14 may be made storable on the opposite side of the machine gun conversion means 16 so that any toy weapon configuration utilizing the machine gun conversion means 16 as a part thereof could have the unused components—namely, the sword or tube conversion means 14, 18—stored thereon (i.e., physically maintained with the toy weapon although not as part of the actual toy weapon configuration).

To summarize, the present invention provides a kit for assembling a plurality of toy weapons wherein the basic weapon and at least one of the first plurality of conversion means are releasably securable together to form a second plurality of weapons greater than the first plurality of conversion means available. In a preferred embodiment, at least one of the conversion means, when used, substantially conceals and converts the identity and essential appearance of the basic weapon. In a preferred embodiment, the basic weapon includes means for producing light and sound effects, the light and sound effects produced varying with the conversion means attached thereto to form the different weapon configurations. The basic weapon and the various conversion means may easily be assembled and disassembled without the use of tools.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A kit for assembling a plurality of toy weapons, comprising:

(A) a basic weapon having a first configuration; and (B) a first plurality of conversion means for converting said basic weapon to a second plurality of different weapon configurations, said basic weapon and said conversion means in said first plurality being releasably securable together to form a second plurality of weapons, said second plurality being greater than said first plurality and including at least one weapon configuration wherein said basic weapon and at least one of said conversion means are releasably securable together and extend through and beyond each end of another of said conversion means.

2. The kit of claim 1 wherein one of said first plurality of conversion means and another of said first plurality of conversion means are directly releasably securable together to form with said basic weapon a third weapon different from both said basic weapon and said second plurality of weapons.

3. The kit of claim 1 wherein at least a portion of one of said conversion means and at least a portion of said basic weapon are releasably securable together to form one of said second plurality of weapons in a substantially telescopic manner.

4. The kit of claim 1 wherein said first plurality is at least three.

5. The kit of claim 1 wherein said second plurality is at least six.

6. The kit of claim 1 wherein said first plurality is not in excess of three and said second plurality is at least six.

7. The kit of claim 1 wherein said first plurality is not in excess of three and said second plurality is at least five.

8. The kit of claim 1 wherein said first plurality is not in excess of three and said second plurality is at least four.

9. The kit of claim 1 wherein said first plurality is not in excess of two and said second plurality is at least three.

10. The kit of claim 1 wherein one of said first plurality of conversion means is releasably secured directly to said basic weapon in one of said second plurality of different weapon configurations and to another one of said first plurality of conversion means in another of said second plurality of different weapon configurations.

11. A kit for assembling a plurality of toy weapons, comprising:

(A) a basic weapon having a first configuration; and (B) a first plurality of conversion means for converting said basic weapon to a second plurality of different weapon configurations, said basic weapon and said conversion means in said first plurality being releasably securable together to form a second plurality of weapons, said second plurality being greater than said first plurality and including at least one weapon configuration wherein at least a substantial portion of said basic weapon spaced from the ends thereof is received within and concealed by one of said conversion means;

said basic weapon and at least one of said conversion means being releasably securable together and extending through and beyond each end of another of said conversion means, one of said first plurality of conversion means and another of said first plurality of conversion means being directly releasably securable together to form with said basic weapon a third weapon different from both said basic weapon and said second plurality of weapons;

at least a portion of one of said conversion means and at least a portion of said basic weapon being telescopically releasably securable together to form one of said second plurality of weapons; and one of said first plurality of conversion means being releasably secured directly to said basic weapon in one of said second plurality of different weapon configurations and to another one of said first plurality of conversion means in another of said second plurality of different weapons configurations.

12. A kit for assembling a plurality of toy weapons, comprising:

(A) a basic weapon having a first configuration including a compartment for a portable power supply, means associated with said power supply for providing light when activated, and a plurality of means associated with said power supply for producing different sounds when activated; and (B) a first plurality of conversion means for converting said basic weapon to a second plurality of different weapon configurations, said basic weapon and each of said conversion means being releasably securable together to form a second plurality of weapons.

13. The kit of claim 12 wherein said basic weapon additionally includes a first plurality of manually operable triggers, each of said triggers activating said light providing means and a respective one of said plurality of sound providing means.

14. The kit of claim 13 wherein said basic weapon and a given one of said first plurality of conversion means includes a switch means, actuated by the releasable securing together of said basic weapon and said one conversion means for changing the sounds generated by said sound producing means upon subsequent operation of said triggers.

15. The kit of claim 13 wherein said basic weapon has first contacting means, and at least one of said first plurality of conversion means has a second plurality of manually operable triggers and second contact means, said second contact means being engageable with said first contact means for varying the sound provided by said sound providing means upon operation of said first and second plurality of triggers.

16. The kit of claim 15 wherein one of said at least one conversion means and another of said first plurality of conversion means includes a switch means, actuated by the releasable securing together of said basic weapon, said at least one conversion means and said another conversion means, for changing the sounds generated by said sound producing means upon subsequent operation of said triggers.

17. The kit of claim 13 wherein one of said first plurality of conversion means includes a manually operable switch means for changing all of the sounds provided by operation of each of said triggers to different sounds.

18. A kit for assembling a plurality of toy weapons, comprising:

(A) a basic weapon having a first configuration;

(B) first conversion means for converting said basic weapon to a second configuration, at least a portion of said basic weapon and at least a portion of said first conversion means being releasably securable together to form a second weapon;

(C) second conversion means for converting said basic weapon to a third configuration, at least a portion of said basic weapon and at least a portion of said second conversion means being telescopically releasably securable together to form a third weapon, and for converting said second weapon to a fourth configuration, at least a portion of said second weapon and at least a portion of said second conversion means being releasably securable together to form a fourth weapon; and (D) third conversion means for converting said basic weapon to a fifth configuration, at least a portion of said basic weapon and at least a portion of said third conversion means being releasably securable to form a fifth weapon, and for converting said third weapon into a sixth configuration, at least a portion of said third weapon and at least a portion of said third conversion means being releasably securable together to form a sixth weapon, and for converting said fourth weapon into a seventh configuration at least a portion of said fourth weapon and at least a portion of said third conversion means being releasably securable together to form a seventh weapon.

19. The kit of claim 18 wherein said third conversion means is releasably secured directly to said basic weapon in said fifth configuration and to said second conversion means in said sixth and seventh configurations.

20. The kit of claim 18 wherein said basic weapon includes a compartment for a portable power supply, means associated with said power supply for providing light when activated, and a plurality of means associated with said power supply for producing different sounds when activated.

21. The kit of claim 20 wherein said basic weapon additionally includes a first plurality of manually operable triggers, each of said triggers activating said light providing means and a different one of said plurality of sound providing means.

22. The kit of claim 21 wherein said basic weapon contains first contact means, said second conversion means additionally includes a second plurality of manually operable triggers and second contact means, said second contact means being engageable with said first contact means for varying the sounds provided upon operation of said first and second pluralities of triggers.

23. The kit of claim 21 wherein said basic weapon includes a switch, actuated by the releasable securing of said third conversion means and said basic weapon together, for changing the sounds generated by subsequent actuation of said first plurality of triggers.

24. The kit of claim 21 wherein said second conversion means includes manually operable switching means for changing all of the sounds provided by operation of each of said triggers to different sounds.

25. The kit of claim 21 wherein said second conversion means includes means for sensing the releasable securing together of said first and third conversion means thereto and for causing said sound providing means to provide different sounds upon operation of said triggers.

26. The kit of claim 1 wherein a substantial portion of said basic weapon spaced from the ends thereof is received within and concealed by one of said conversion means.

* * * * *